US011186470B2

(12) United States Patent
Anderson

(10) Patent No.: US 11,186,470 B2
(45) Date of Patent: Nov. 30, 2021

(54) MULTI-TINE LIFTING IMPLEMENT

(71) Applicant: Deloren E. Anderson, Crosby, MN (US)

(72) Inventor: Deloren E. Anderson, Crosby, MN (US)

(73) Assignee: DeLoren E. Anderson, Crosby, MN (US)

( * ) Notice: Subject to any disclaimer, the term of this patent is extended or adjusted under 35 U.S.C. 154(b) by 0 days.

(21) Appl. No.: 16/372,087

(22) Filed: Apr. 1, 2019

(65) Prior Publication Data

US 2019/0300350 A1 Oct. 3, 2019

Related U.S. Application Data

(60) Provisional application No. 62/650,801, filed on Mar. 30, 2018.

(51) Int. Cl.
*B66F 9/12* (2006.01)
*B66F 9/18* (2006.01)

(52) U.S. Cl.
CPC . *B66F 9/12* (2013.01); *B66F 9/18* (2013.01)

(58) Field of Classification Search
CPC .... B66F 9/18; B66F 9/12; B66F 9/065; E02F 3/962; B66C 1/10; B66C 1/22; B66C 1/223; B66C 1/105; B66C 1/66; B66C 1/666; B66C 1/663; B66C 3/04; B66C 3/02
USPC ..... 414/623, 724, 736, 408, 510; 294/67.2, 294/67.22, 67.3, 86.12; 212/242, 243, 212/259; 37/405
See application file for complete search history.

(56) References Cited

U.S. PATENT DOCUMENTS 2,886,905 A * 5/1959 Bayles ..... E02F 3/60 37/398
3,034,237 A * 5/1962 Wolfe ..... E02F 3/8152 37/405
3,079,021 A * 2/1963 Kohorst ..... E02F 3/407 414/725
3,362,554 A * 1/1968 Fortier ..... A01C 3/04 414/703
3,706,388 A * 12/1972 Westendorf ..... E02F 3/401 414/724
5,564,885 A * 10/1996 Staben, Jr. ..... E02F 3/962 414/724
6,146,081 A * 11/2000 Anderson ..... B66F 9/12 414/685
6,718,662 B1 * 4/2004 Schaff ..... E02F 3/8152 171/43
2004/0120608 A1 * 6/2004 Jardine ..... B66F 9/18 383/24
2006/0243465 A1 * 11/2006 Kallevig ..... B66F 9/12 172/378
2011/0078930 A1 * 4/2011 Dunn ..... E02F 3/401 37/405

(Continued)

*Primary Examiner* — Glenn F Myers
(74) *Attorney, Agent, or Firm* — Schwegman Lundberg & Woessner, P.A.

(57) ABSTRACT

The present subject matter relates to a multi-tine lifting implement, which, when mounted on a vehicle such as a skid steer loader, can pry and lift objects such as concrete or asphalt slabs or pavement, pieces of concrete or asphalt, rocks, shrubs, small trees, and the like. The implement has removeable sides, and a top portion that is removeable and replaceable with a grapple. Tines may be supported by reinforced sleeves.

15 Claims, 30 Drawing Sheets

(56) References Cited

U.S. PATENT DOCUMENTS

| | | | | |
|---|---|---|---|---|
| 2011/0236170 | A1* | 9/2011 | Fritsch | E02F 3/3414<br>414/724 |
| 2017/0362794 | A1* | 12/2017 | Heath | E02F 3/3645 |

* cited by examiner

MULTI-TINE LIFTING IMPLEMENT

RELATED APPLICATION

This application claims priority to U.S. Provisional Application Ser. No. 62/650,801 (entitled MULTI-TINE LIFTING IMPLEMENT, filed Oct. 18, 2002) which is incorporated herein by reference.

BACKGROUND

Many different devices are available for lifting and moving materials such as pieces of concrete or asphalt, trees or shrubs, and the like. Vehicles of various kinds can be used to manipulate these moving and lifting devices for prying, pushing, lifting, moving, and releasing such materials. In certain situations it is desirable to pry, lift and/or move larger materials, such as chunks of concrete, a tree with its root ball, or a stump, while sifting out smaller materials, such as gravel and soil. For example, when breaking up a concrete or asphalt pavement, it is typically desired to leave the underlayment in place for resurfacing. When uprooting a tree, shrub or stump, either for transplantation or removal, it is often desirable to leave much of the surrounding soil at the original site of the tree, shrub, or stump.

A variety of lifting and moving attachments are available for a vehicle such as a skid steer loader. One typical attachment is a bucket that can be used for digging, prying and lifting an object. Typical buckets lack length useful for gaining leverage in prying and have sides that prevent the bucket from being pushed a useful distance under, for example, a concrete slab. Furthermore, a bucket retains all material scooped, no matter its size. Pallet forks are useful for picking up objects with a wide, flat, and even base, but are not suited for penetrating beneath, prying and lifting a tree or pavement. Various devices for digging or grasping trees are not suitable for other general lifting and prying purposes.

There remains a need for an implement that can be attached to a vehicle such as a skid steer loader and that is suitable for lifting and prying, and allowing smaller objects to fall or be shaken out of the implement.

DETAILED DESCRIPTION

In the following description, reference is made to the accompanying drawings that form a part hereof, and in which is shown by way of illustration specific embodiments that may be practiced. These embodiments are described in sufficient detail to enable those skilled in the art to practice the subject matter, and it is to be understood that other embodiments may be utilized, and that structural, logical, and electrical changes may be made without departing from the scope of the present subject matter. The following description of example embodiments is, therefore, not to be taken in a limited sense, and the scope of the present subject matter is defined by the appended claims.

The subject matter includes a multi-tine lifting implement that can be mounted on a vehicle, such as a skid steer loader, having arms or another apparatus for moving multi-tine lifting implement up and down and/or for tilting the multi-tine lifting implement relative to the ground. The multi-tine lifting implement includes a coupling system for connecting to the arms, or other implement support system, of the vehicle. The coupling system can be a component of a support member, which supports a tine system. The tine system includes a plurality of tines having a blade that extends laterally from a proximal end along a lower edge of the support system to a distal end. The tines extend from the proximal to the distal end and define voids allowing the tine system to support rocks, pieces of concrete or asphalt, a root ball of a tree or shrub, or the like without holding smaller objects. Preferably, the implement includes a member for stabilizing the tines against undesirable lateral or torsional movement.

The present subject matter relates to an implement, which, when mounted on a vehicle, typically a loader such as a skid steer loader, a track loader, a wheel loader, or the like, can pry and lift objects such as concrete or asphalt slabs or pavement, pieces of concrete or asphalt, rocks, shrubs, small trees, and the like. Typically, the implement is mounted on arms or another apparatus for moving the implement up and down and for tilting the implement relative to the ground. A multi-tined lifting implement employs a plurality of tines which are advantageous for inserting beneath the object to be pried or lifted providing a narrow cross section that encounters reduced resistance from the material under the object to be pried or lifted and which have a length advantageous for providing leverage in prying and lifting. The tines are configured advantageously for prying and lifting larger objects and allowing smaller objects to fall or be shaken out of the implement.

Figure 1:
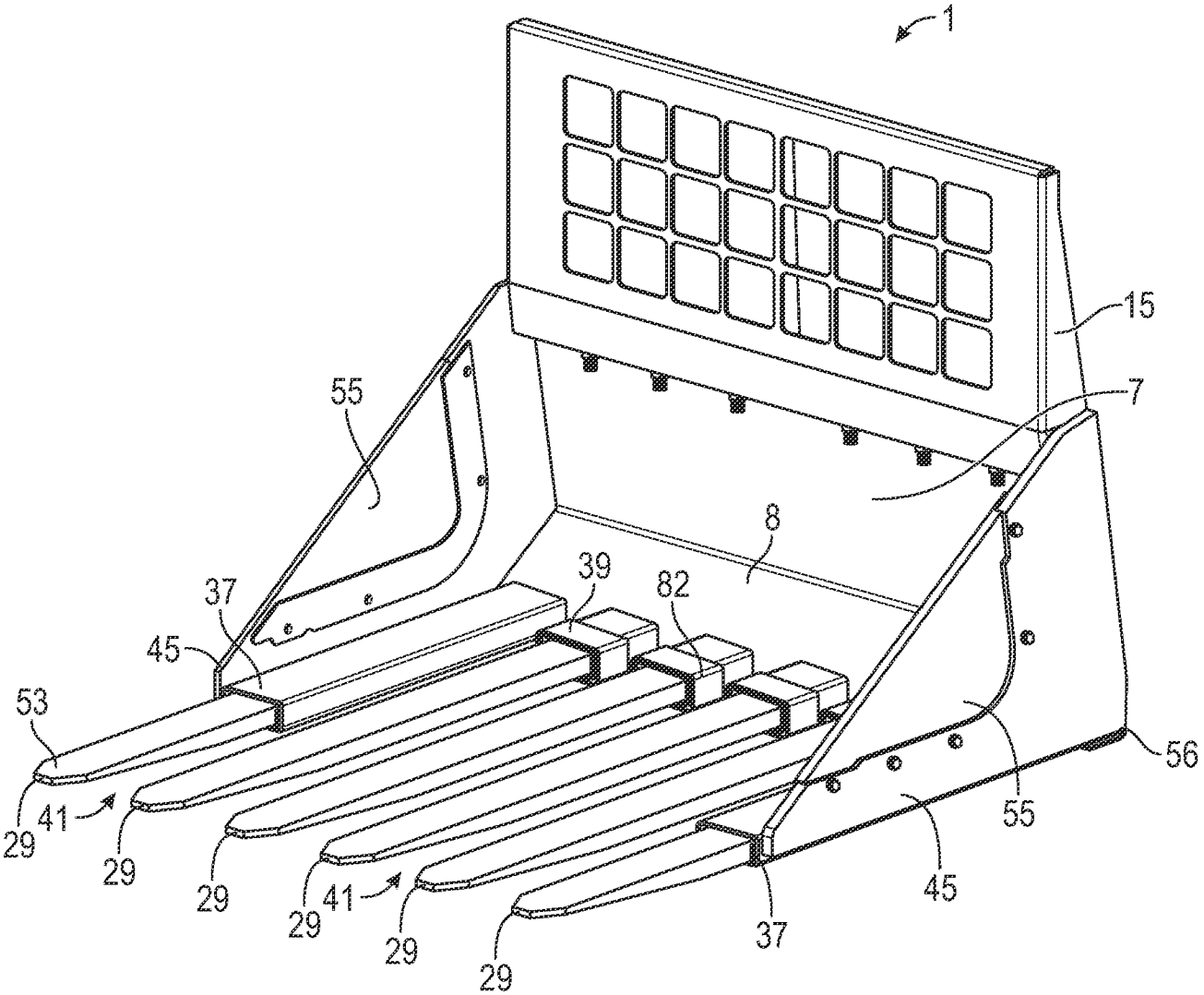
FIG. 1 illustrates a perspective view of an embodiment of the present multi-tine lifting implement.

FIG. 1 illustrates a perspective view of an embodiment of the present multi-tine lifting implement generally at 1. FIG. 1 shows a multi-tine lifting bucket with removable sides and a removable top. The multi-tined lifting implement also, preferably, includes one or more side members for retaining an object on the tine system during prying, lifting, and transport operations to prevent lateral movement of the object off of the lifting implement. Typically, a multi-tined lifting implement includes a support member which couples the implement to and supports the implement on a vehicle, such as a skid steer loader, and supports the tine system. The tine system includes three or more tines which project forward from the support member and are spaced for prying and lifting objects such as trees, shrubs, rocks, and pieces or slabs of concrete or pavement, but allowing smaller objects to fall between the tines. One or both of the side members may be removable to accommodate for various objects loaded onto the implement. For example, a first side member may be removed, and an end of an elongated object (e.g., a log longer than the implement width) may be placed within a pocket formed by a second side member and extending through the opening provided by the removed first side member.

A variety of mechanisms are known in the art for coupling an implement to a vehicle such as a loader and, in one or more embodiments, multi-tine lifting implement can include a coupling system suitable for coupling to each such mechanism. For example, skid steer loaders and like vehicles can include as standard equipment one of several known coupling systems for mounting implements on the loader, and multi-tine lifting implement can include any of several known designs of coupling system for coupling to vehicle-coupling systems. Some loaders, in particular heavier loaders, employ for coupling to an implement one or more arm holes on the end of each arm that lifts and/or tilts the implement. Each arm hole corresponds to a hole defined by a rearward facing tab, a tab hole, on the implement, a pin and, typically, a sleeve fits through the arm hole and tab hole and is retained in these holes by, for example, a pin. The coupling system can include an arrangement of tabs and tab holes for coupling to such loaders.

A support member 7 is a truncated bucket of rugged construction that is configured to support multiple tines 29, side members 45, removable side portions 55, and a removable upper portion 15. A front of the support member is the working portion of the lifting device and has features that support the tines, forming a bucket like opening. The support member 7 includes multiple sleeves, including a pair of outer sleeves 37 and one or more inner sleeves 39. The sleeves extend forward from the support member 7 into the bucket like opening and support the multiple tines 29. The support member 7 may include a triangular construction at a base of the support member to provide additional support for the sleeves as indicated at 8.

In further embodiments, any means of supporting tines 29 that may or may not utilize sleeves may be used. For example, L-shaped tines may be utilized such as those shown in U.S. Pat. No. 6,146,081, which is incorporated herein by reference at least for its teaching of the use of L-shaped tines, and the means of supporting them in a lifting implement.

The side members 45 extend from a back edge of the support member forward along the length of the outer sleeves 37 to provide additional support for the outer sleeves and added strength for lifting and prying via the bucket opening. Note that the outer sleeves are generally longer than the inner sleeves. The side members 45 include openings for bolts or other attachment devices to removably attach the side portions 55.

Figure 2:
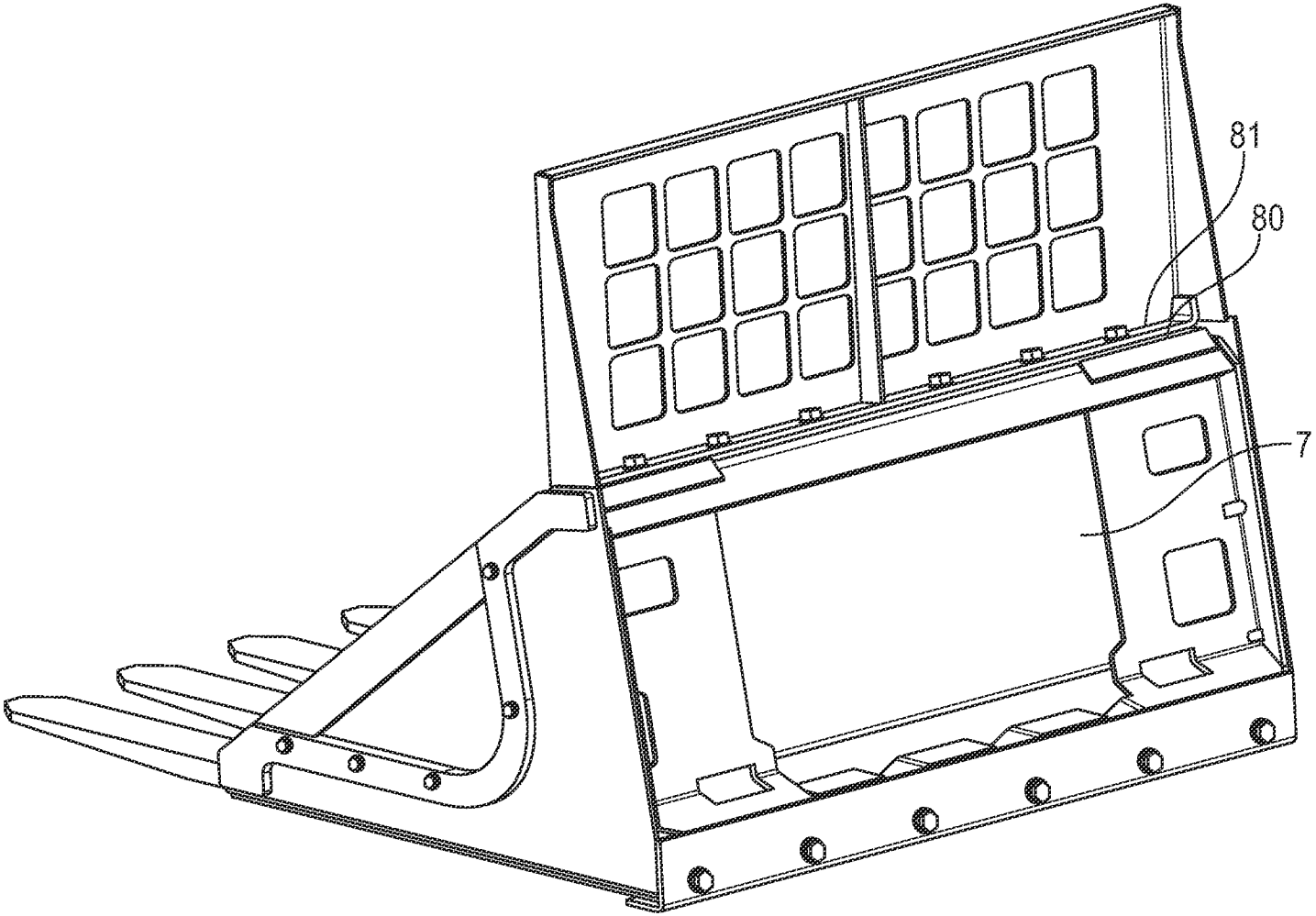
FIG. 2 illustrates a perspective view of an embodiment of the present multi-tine lifting implement.

FIG. 2 illustrates a back side of the lifting implement. The back of the support member 7 has openings to facilitate attachment to a vehicle as with existing buckets. A top part of the support system is a generally flat horizontal plate 80 having a coupling system, such as openings for bolts or other attachment mechanism to removably attach upper portion 15, or other devices, such as a grapple shown and described below. The plate is obstructed from view by the attached upper portion 15 in FIG. 2, but has the same general shape as a mating plate 81 of the upper portion 15. Note that in one embodiment, the upper portion 15 has a portion extending downward from the plate 81 into the bucket like opening.

A variety of mechanisms are known in the art for supporting tine based lifting implements or another type of implement on a vehicle such as a loader and, in one or more embodiments, multi-tine lifting implement 1 can include a support member 7 suitable for each such mechanism. For example, skid steer loaders and like vehicles can include as standard equipment one of several known support members for mounting tines on the loader, and multi-tine lifting implement 1 can include any of several known designs of support member 7 for coupling to these known vehicle systems. For example, one or more tines 29 can be supported on one or more generally horizontal rods. Numerous systems are known in the art for supporting lift implements on fork lifts and the like, and such systems can be employed for supporting tines 29 of multi-tine lifting implement 1 and can be adapted for use on a loader. In addition, various hook type carriage assemblies are known in the art for forks employed on cargo-handling lift trucks and can be employed in multi-tine lifting implement 1.

Tine 29 can be any of a variety of tines known for use on a cargo-handling lift truck and like vehicles. Typically, tine 26 is made of a hard steel.

Tines 29 are spaced to allow multi-tine lifting implement 1 to retain large objects such as chunks of cement or asphalt, trees or shrubs, stumps or the like, and for smaller objects, such as gravel, soil, and the like, to fall through. Multi-tine lifting implement 1 includes three or more tines 29, preferably about three to about seven tines 29, preferably about five to about six tines 29. Tine system 27 is advantageously configured for prying and lifting larger objects, such as chunks or slabs of pavement or cement and the like, and allowing smaller objects to fall or be shaken out of multi-tine lifting implement 1. Lift implement 1 can include a plurality of generally parallel and coplanar tines 29 that project forward from support member 7. Typically, adjacent tines define a void 41 between them of about one to about eighteen inches, preferably about two to about five inches, preferably about three inches.

The flat cross section presented by the tines 29 is advantageous for providing a wide lifting member that presents an advantageously small cross section to material to be penetrated to pry or lift an object. This is in contrast to an implement which employs teeth mounted edgewise to increase the strength of the teeth, but which provides a larger number of teeth than tines and a resulting increase in the cross-sectional area that must penetrate the material under an object for prying or lifting. This increase in cross section disadvantageously requires increased power to insert the teeth under the object.

In some embodiments, the tines are horizontally flat compared to their width, providing a lighter weight tine than many prior tines. In one embodiment, the tines are approximately 1.125 to 1.5 inches thick and approximately 4 inches wide. Such dimensions are approximate if within a range of 1 to 10 percent for example, or within conventional manufacturing tolerances. In a further embodiment, the tines may be 3×8 inches. In still further embodiments, the tines may be wider, narrower, thinner, or thicker.

Figure 3:
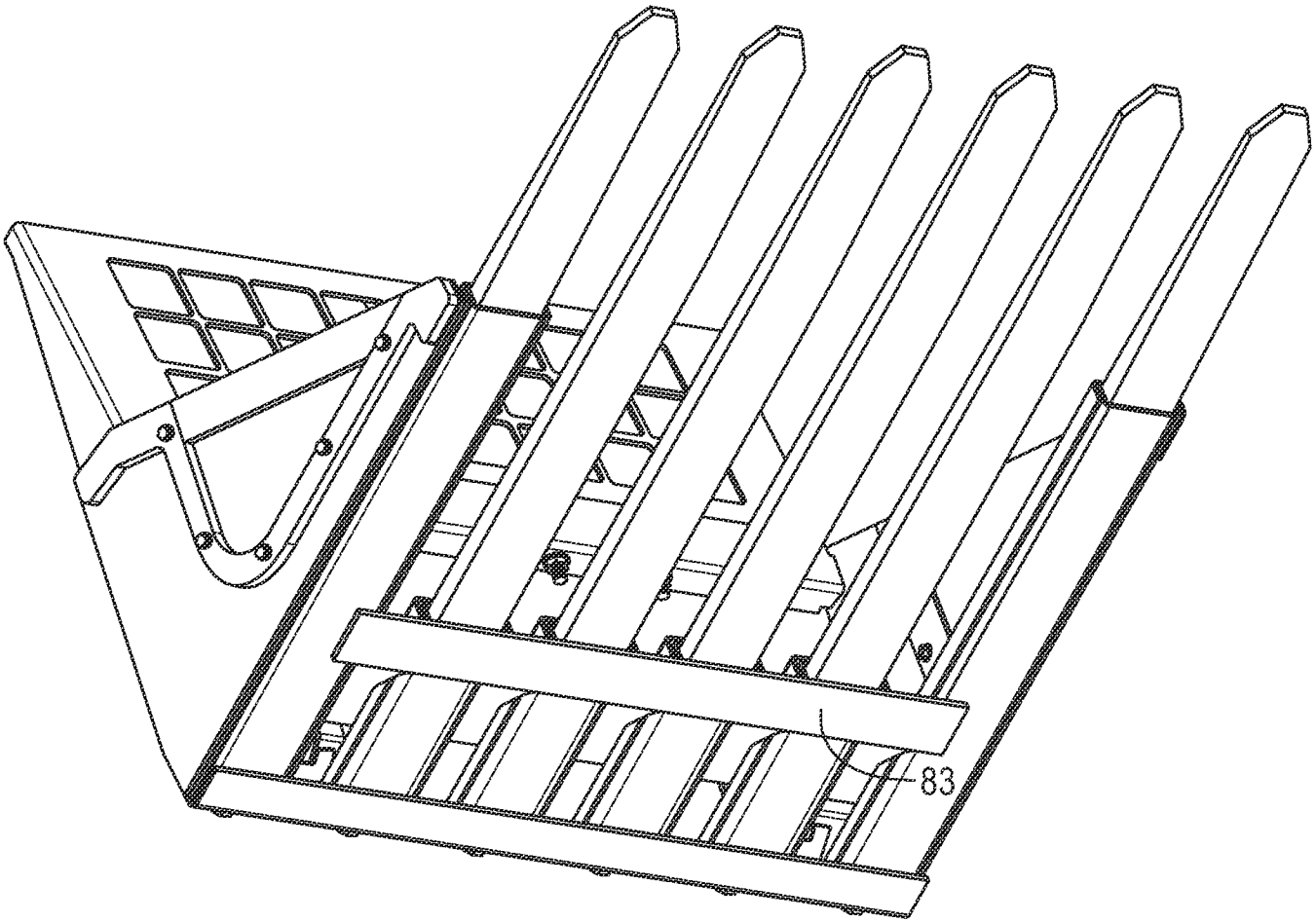
FIG. 3 illustrates a perspective view of an embodiment of the present multi-tine lifting implement.

The sleeves 39 can also include a reinforcing strap 82 that wraps around and connects each sleeve to restrict movement of tine 29 with respect to support member 7 and to retains tines 29 in a generally parallel orientation. Movement of tine 29, such as twisting, lifting, sliding, and the like, relative to support member 7 can cause unacceptable wear on components of multi-tine lifting implement 1. Strap 82 prevents or reduces such harmful movement of tine 29. A stabilizing bar 83 may extend beneath and across the sleeves as shown in FIG. 3. The strap 82 may couple to the bar or spanning member 83 in some embodiments to provide further stabilization of the sleeves and tines. Spanning member 83 spans voids between sleeves to form a generally rigid stabilized lifting implement. Sleeves may fit over tines with a gap between each tine and corresponding sleeve. For example, sleeves can be made from square tubing dimensioned slightly larger than the tine. Advantageously, sleeves are not welded or otherwise coupled to tines to provide advantageous shock absorbing and a small degree of flexibility in movement of the tines. Each sleeve and/or spanning member may be coupled to support member 7.

Edge sleeves can fit over an edge tine (a tine on an outermost edge) and extends farther in a forward direction (is longer) than interior sleeves. Advantageously, edge sleeves provide additional stability to an outermost tine and is coupled to side member 45. Typically edge sleeves are about twice as long as interior sleeves. Interior sleeves fit over interior tines.

Side members 45 extend upward from corresponding edge tines or from edge sleeves on either edge of the implement and extend forward from the support member 7. Side members are arranged and configured for preventing objects from falling off of tines and provide support for the tines.

Typically, multi-tine lifting implement 1 is mounted on a vehicle, such as a skid steer loader, having arms or another apparatus for moving multi-tine lifting implement 1 up and down and/or for the tilting multi-tine lifting implement 1 relative to the ground. The orientation of the multi-tine lifting implement 1 changes as the vehicle or its arms are manipulated by the operator. For inserting under an object, tine blades are generally horizontal or parallel to the ground with support member 7 generally vertical or perpendicular to the ground. For prying an object from the ground, the tine blades can be angled with a distal end 53 lower than a proximal end 56 and, advantageously, employ movement of the vehicle for applying prying force. Tines are advantageous for prying, compared to existing attachments, due to the ability of a loader or like vehicle to exert greater force in tilting that for lifting. In addition, the force of the vehicle moving can provide additional force. For further prying and loosening of the object to be lifted, force can be applied to move distal end 53 upward relative to the proximal end 56. For lifting the object from the ground, distal end 53 can be raised relative to proximal end 56 to cup the object in a void—the bucket like opening—formed by the tines, support member 7, and side members 45 with removable side portion 55 in place. Alternatively, the lifted object can lay on the generally horizontal tine blades.

In the construction of the multi-tine lifting implement components can be coupled, attached or fused by any method suitable for components of a lifting implement for use on a vehicle such as a skid steer loader. As used herein, coupling attaching or fusing a component of the multi-tine lifting implement to another component of the multi-tine lifting implement refers to such methods and includes joining components with one or more welds, a brazed joint, one or more rivets, one or more bolts, one or more screws, and the like. Note that the removable upper and side portions are not welded or otherwise permanently affixed but may be removably attached view bolts, pins, screws, or other temporary attachment means. As used herein, terms such as upper, lower, downward, upward, vertical, horizontal, left, right, and the like are used in association with the accompanying figures in a relative sense and solely for purposes of clarity of description. It will be understood by one of skill in the art that, in use, the multi-tine lifting implement can assume a variety of orientations. As used herein, the phrases "pried or lifted," "prying or lifting," "pry or lift," and variants on these phrases refer to conducting either or both of these operations, either sequentially (in either order) or simultaneously.

Figure 24:
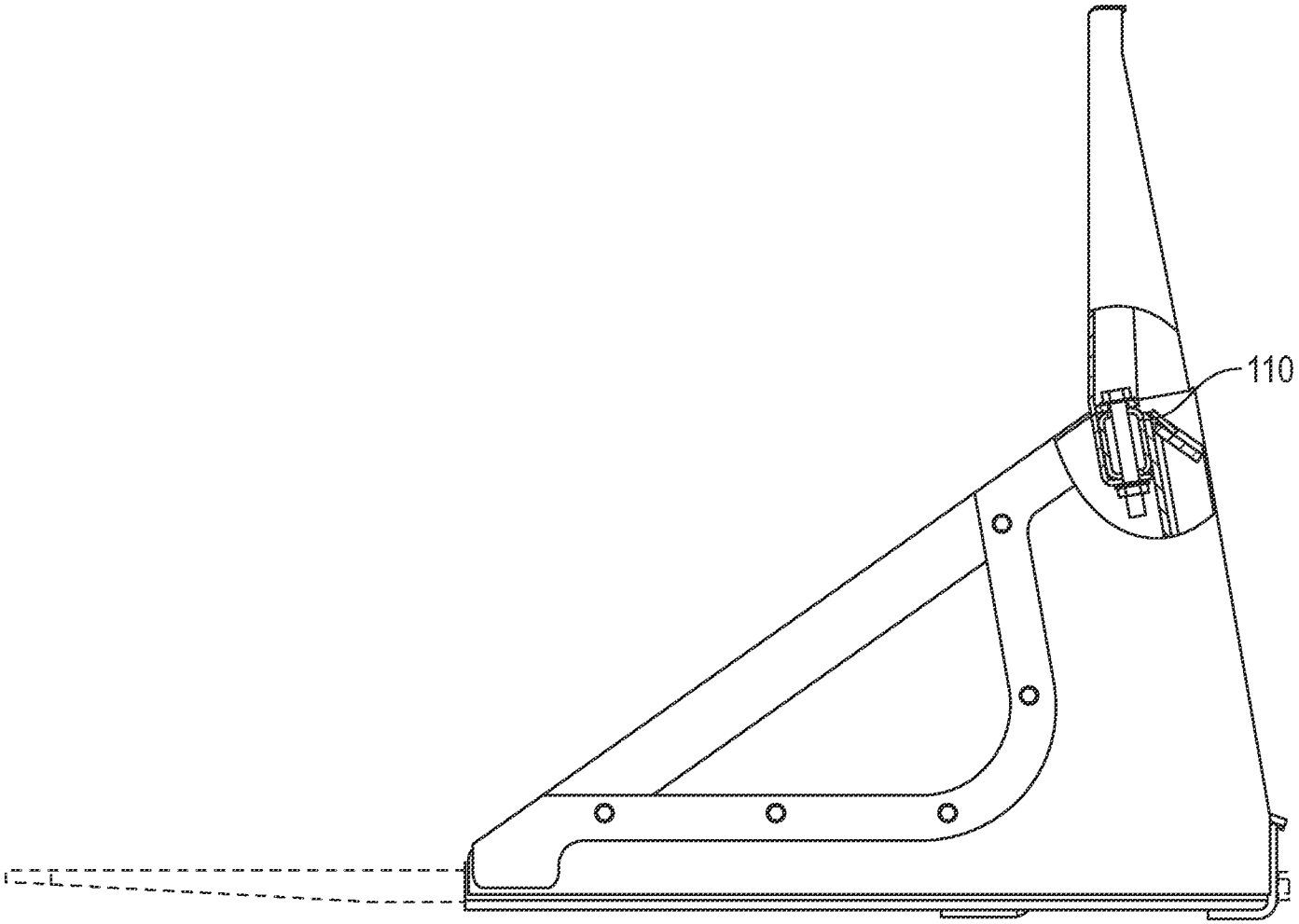
FIG. 24 illustrates a schematic view of an embodiment of the present multi-tine lifting implement.
Figure 25:
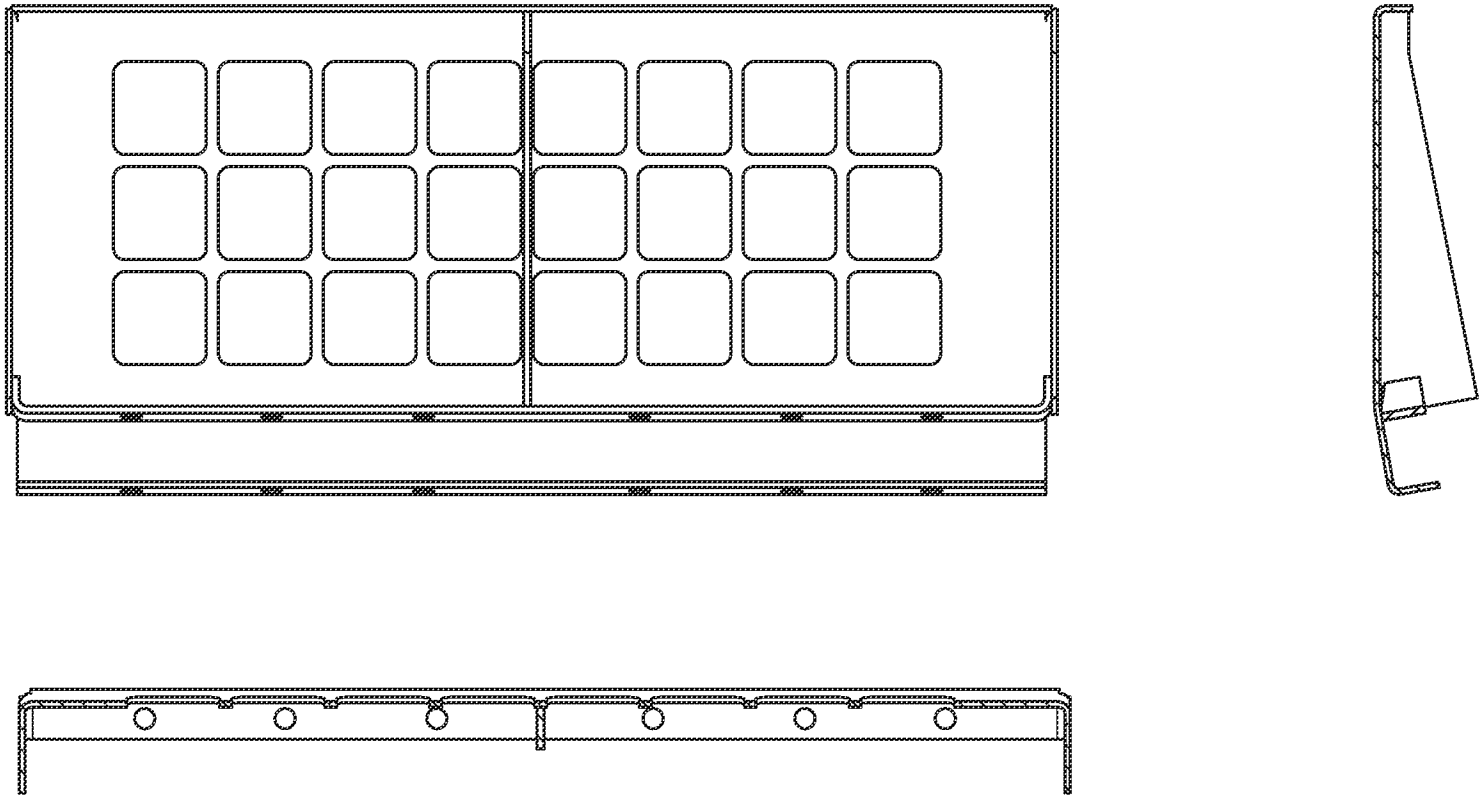
FIG. 25 illustrates a schematic view of an example removable top portion of the present multi-tine lifting implement.
Figure 31:
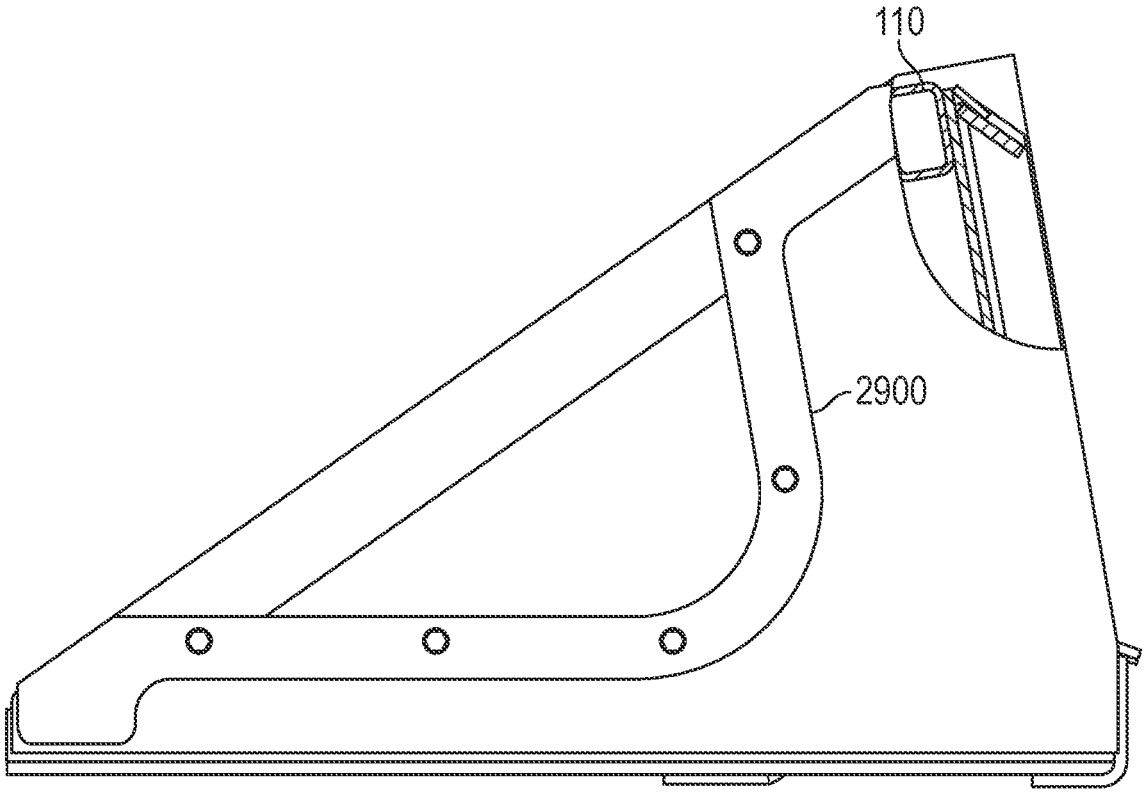
FIG. 31 illustrates a schematic view of an example removable side portion of the present multi-tine lifting implement.

FIG. 2 illustrates a perspective view of an embodiment of the present multi-tine lifting implement. FIG. 2 shows a multi-tine lifting bucket with removable sides and a removable top. In one embodiment, there are six bolts used to removably attach the upper portion 15. The bolts and corresponding openings in the support member may be equally spaced or staggered in a different manner to provide sufficient retentive force. The same openings may be used to attach different devices, such as a grapple described below. In one embodiment, the support member may have a tube 110 with openings to accept the bolts as shown in FIGS. 24, 25, and 31. The upper portion may include flanges to extending over the tube 110 for additional support.

FIG. 3 illustrates a perspective view of an embodiment of the present multi-tine lifting implement. FIG. 3 shows a multi-tine lifting bucket with removable sides and a removable top.

Figure 4:
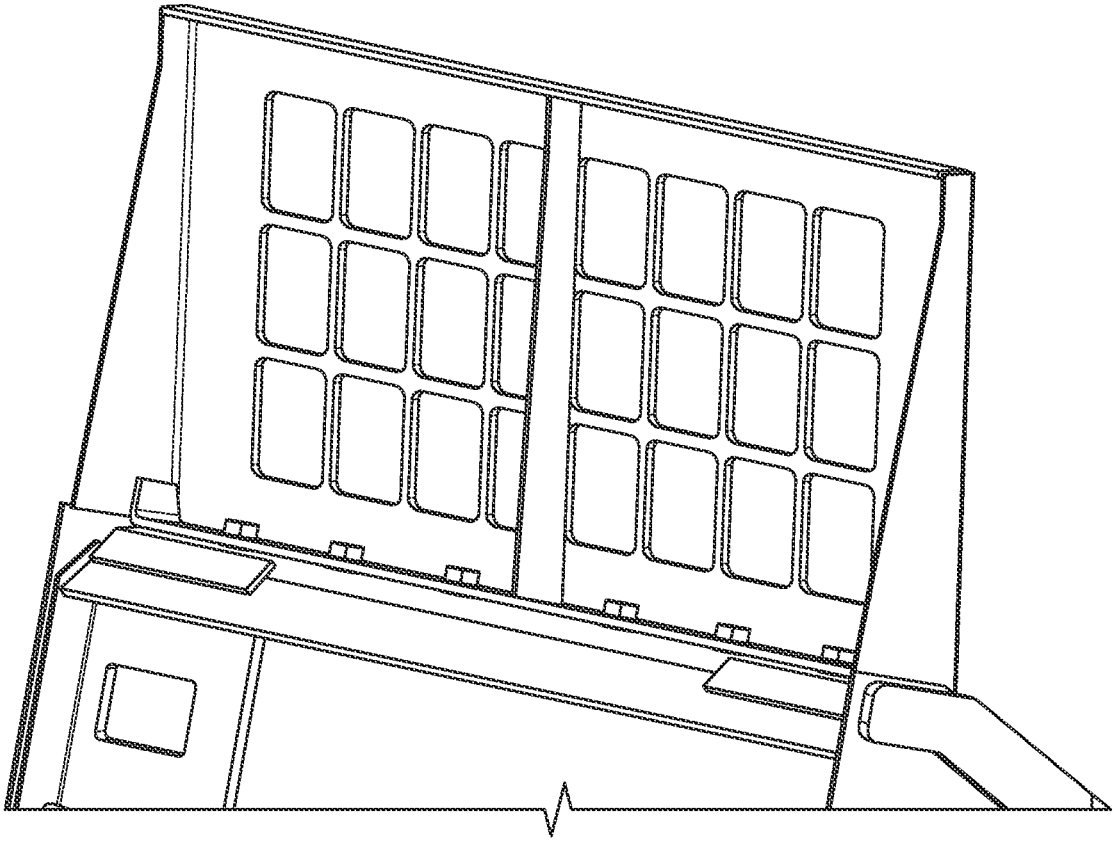
FIG. 4 illustrates a perspective view of an embodiment of the present multi-tine lifting implement.

FIG. 4 illustrates a perspective view of an embodiment of the present multi-tine lifting implement. FIG. 4 shows a multi-tine lifting bucket with removable sides and a removable top.

Figure 5:
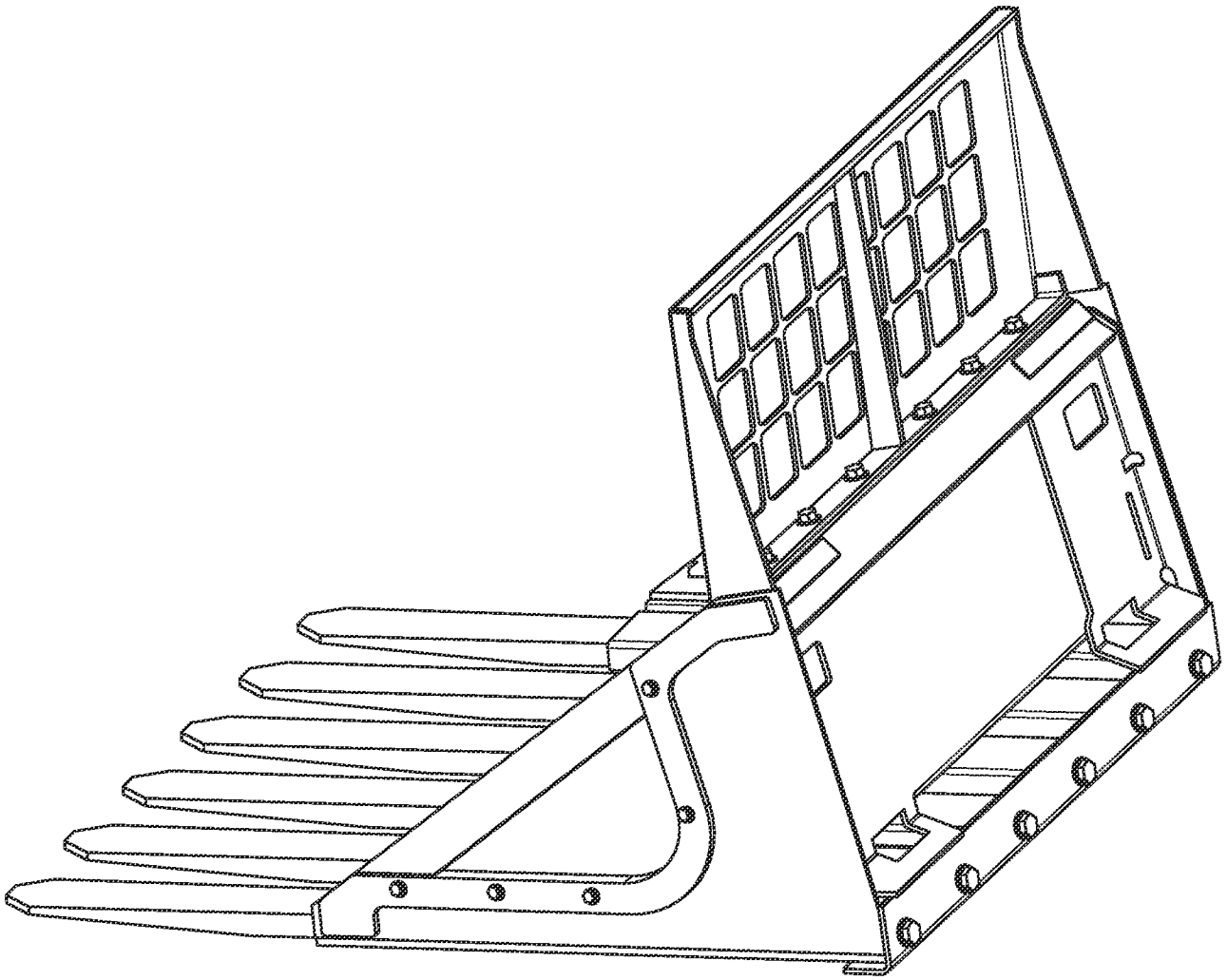
FIG. 5 illustrates a perspective view of an embodiment of the present multi-tine lifting implement.

FIG. 5 illustrates a perspective view of an embodiment of the present multi-tine lifting implement. FIG. 5 shows a multi-tine lifting bucket with removable sides and a removable top.

Figure 6:
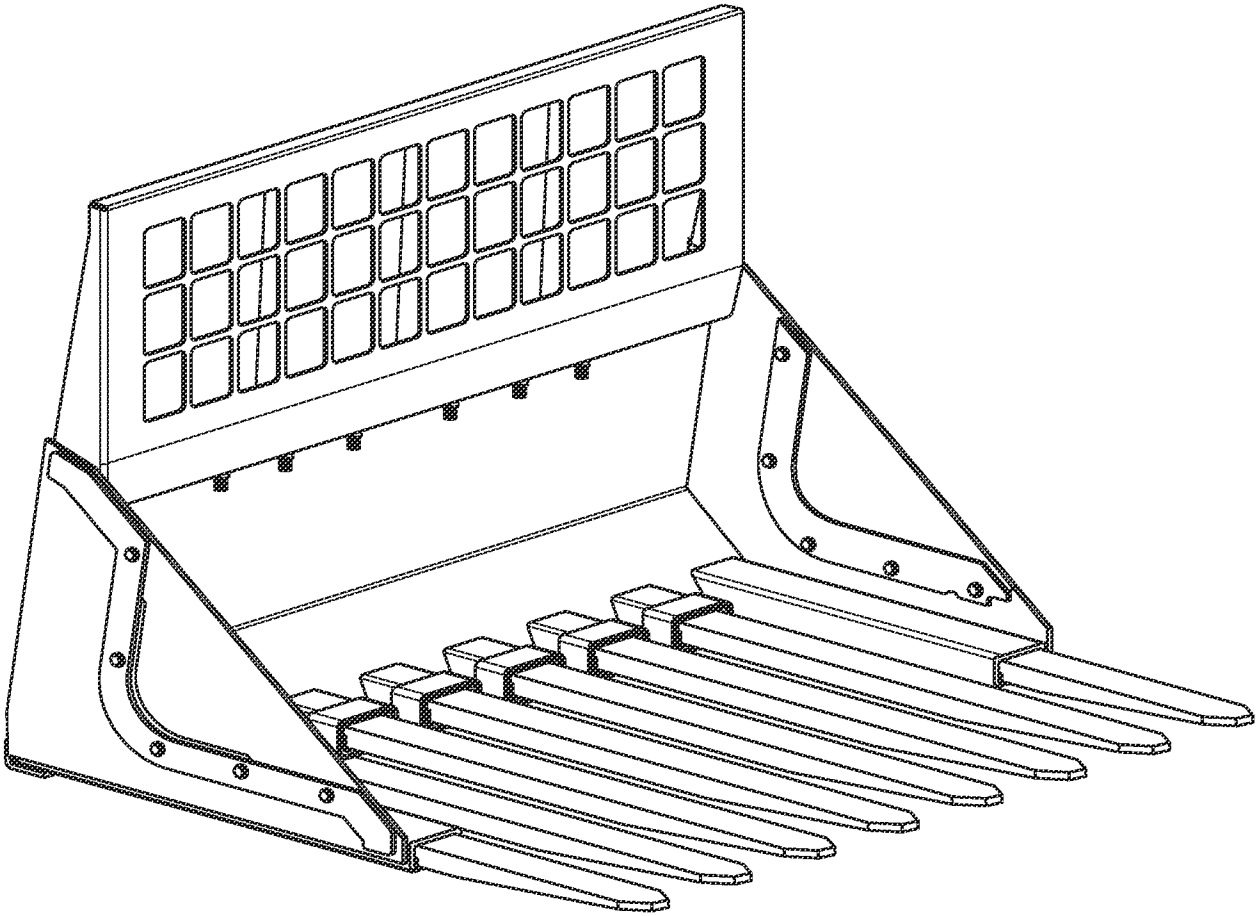
FIG. 6 illustrates a perspective view of an embodiment of the present multi-tine lifting implement.

FIG. 6 illustrates a perspective view of an embodiment of the present multi-tine lifting implement. FIG. 6 shows a multi-tine lifting bucket with removable sides and a removable top.

Figure 7:
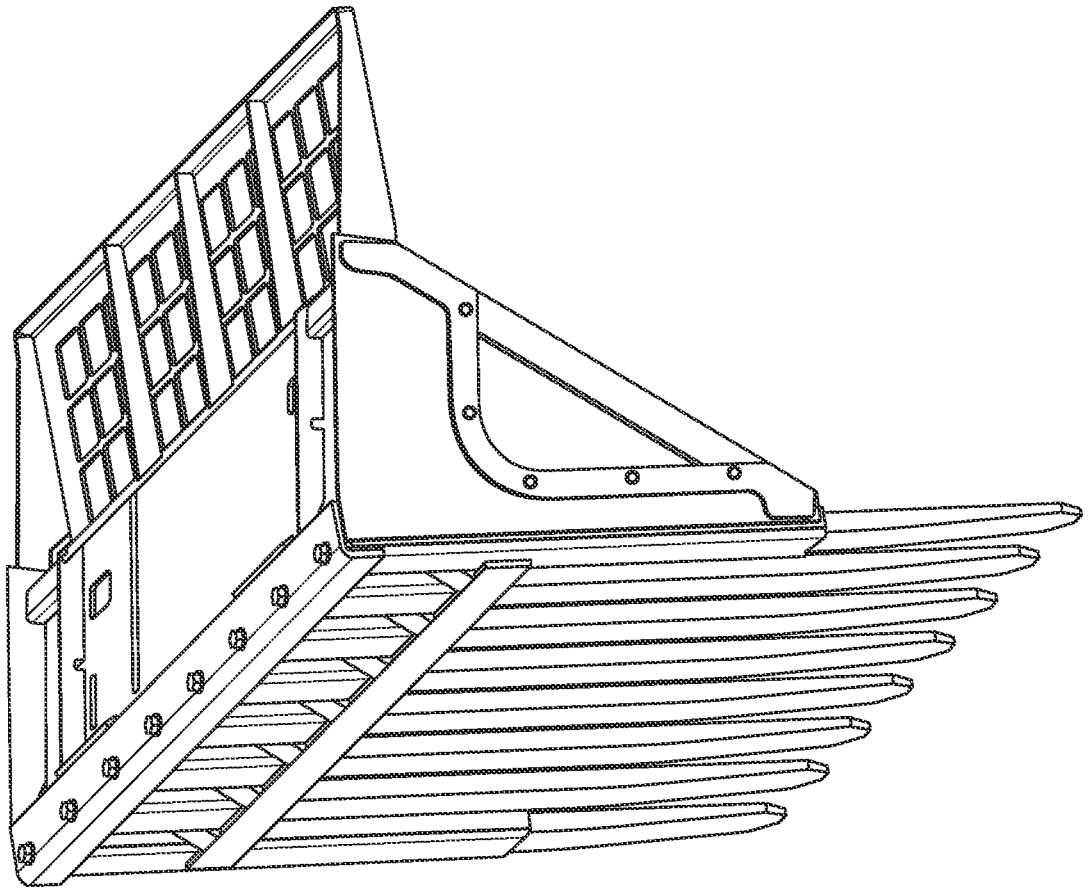
FIG. 7 illustrates a perspective view of an embodiment of the present multi-tine lifting implement.

FIG. 7 illustrates a perspective view of an embodiment of the present multi-tine lifting implement. FIG. 7 shows a multi-tine lifting bucket with removable sides and a removable top. Also shown are bolts used to attach the tines within the sleeves. The bolts are at a back side of the support member 7, with the tines extending forward therefrom.

Figure 8:
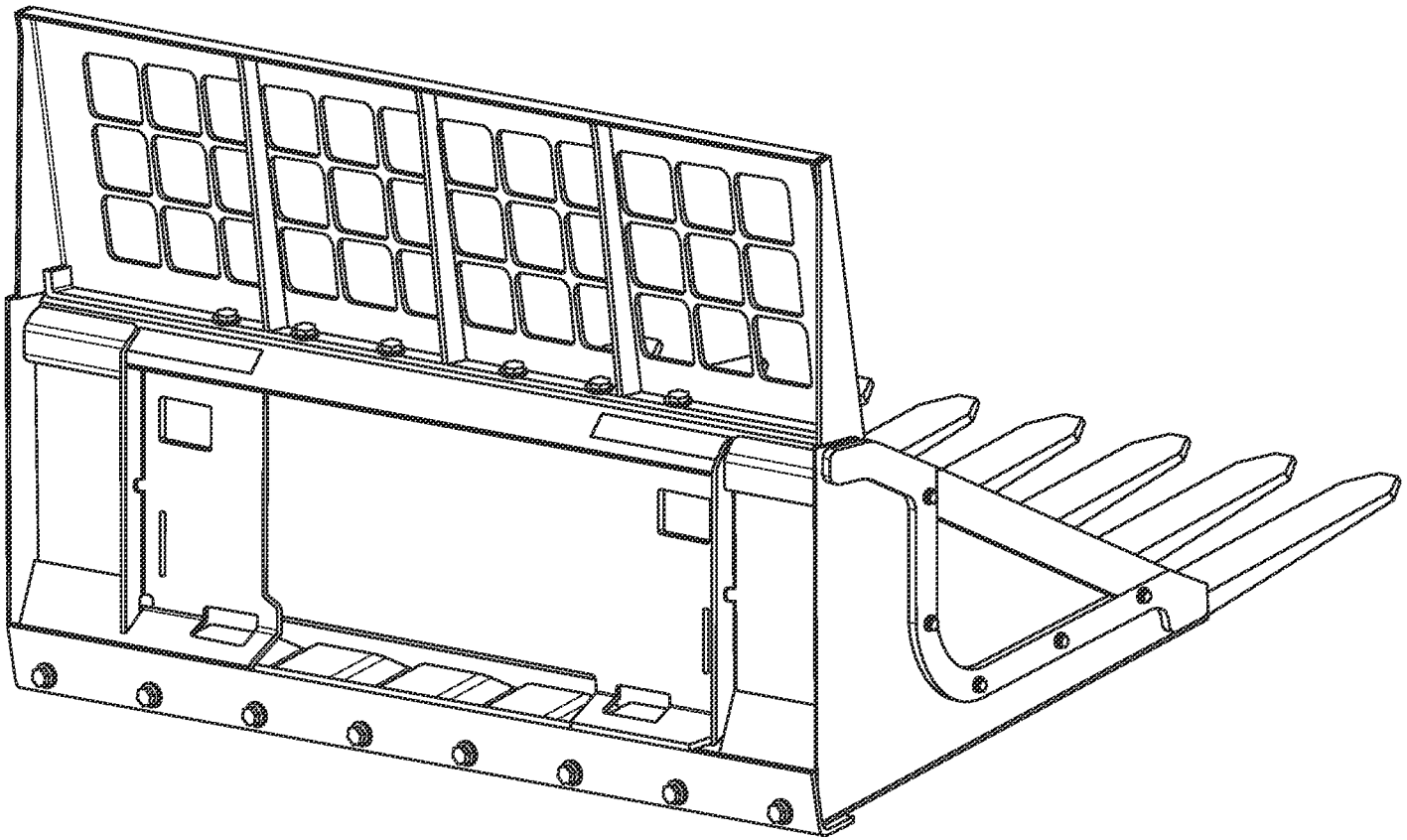
FIG. 8 illustrates a perspective view of an embodiment of the present multi-tine lifting implement.

FIG. 8 illustrates a perspective view of an embodiment of the present multi-tine lifting implement. FIG. 8 shows a multi-tine lifting bucket with removable sides and a removable top. The tine attaching bolts are also shown in FIG. 8, with a view of some of the sleeves extending from the back side toward the triangular portion 8 of the support member.

Figure 9:
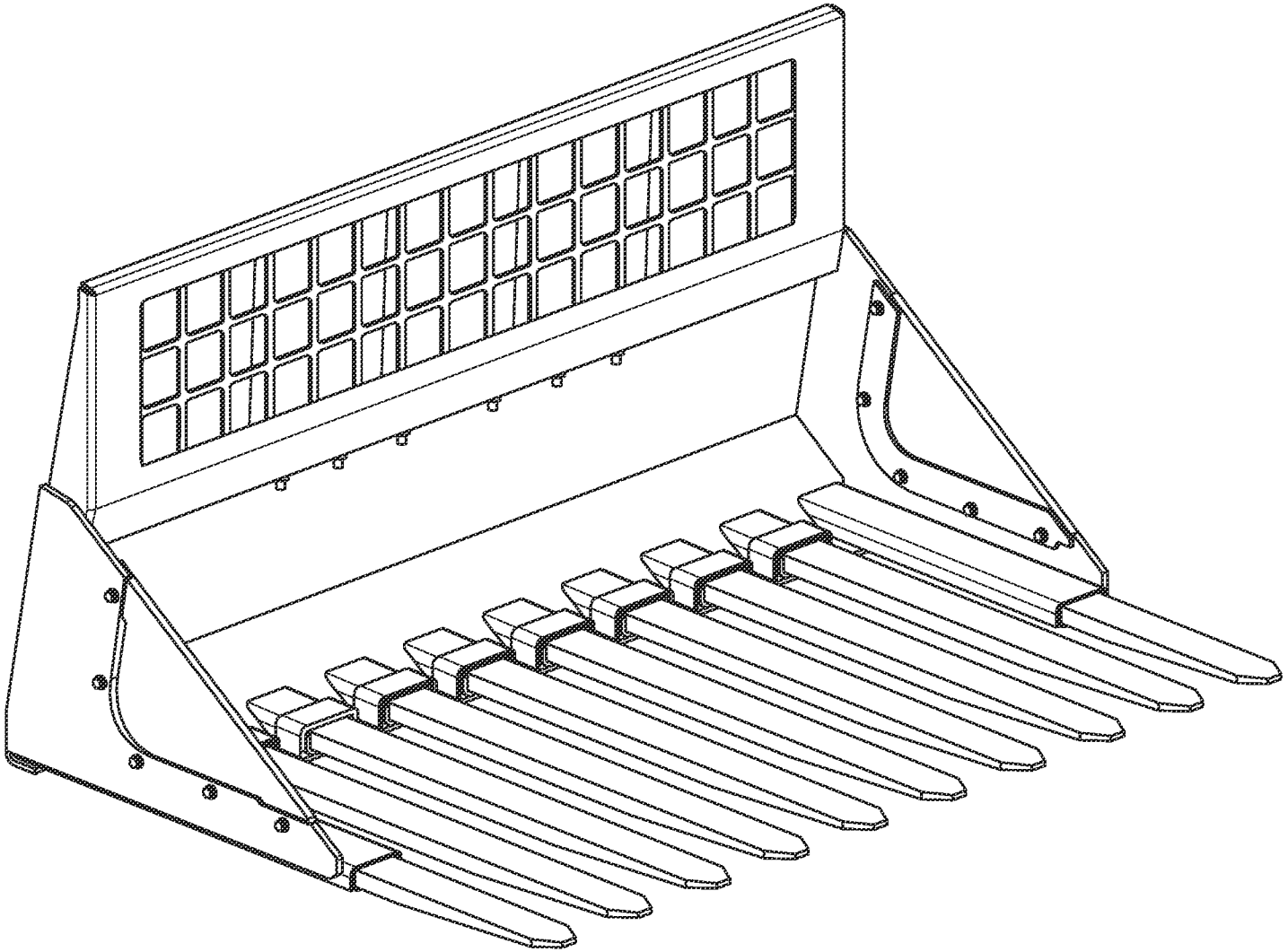
FIG. 9 illustrates a perspective view of an embodiment of the present multi-tine lifting implement.

FIG. 9 illustrates a perspective view of an embodiment of the present multi-tine lifting implement. FIG. 9 shows a multi-tine lifting bucket with removable sides and a removable top.

Figure 10:
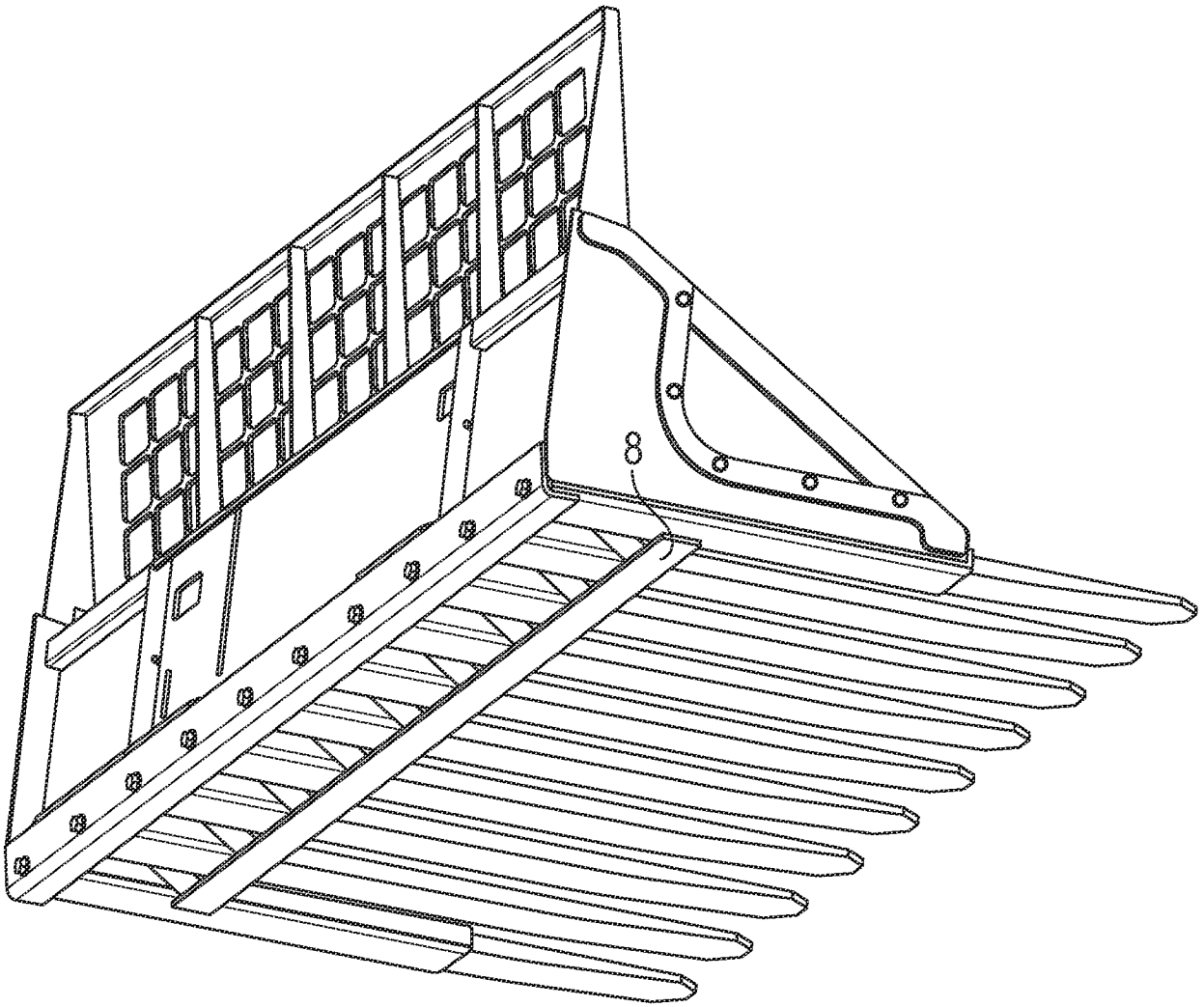
FIG. 10 illustrates a perspective view of an embodiment of the present multi-tine lifting implement.

FIG. 10 illustrates a perspective view of an embodiment of the present multi-tine lifting implement. FIG. 10 shows a multi-tine lifting bucket with removable sides and a removable top.

Figure 11:
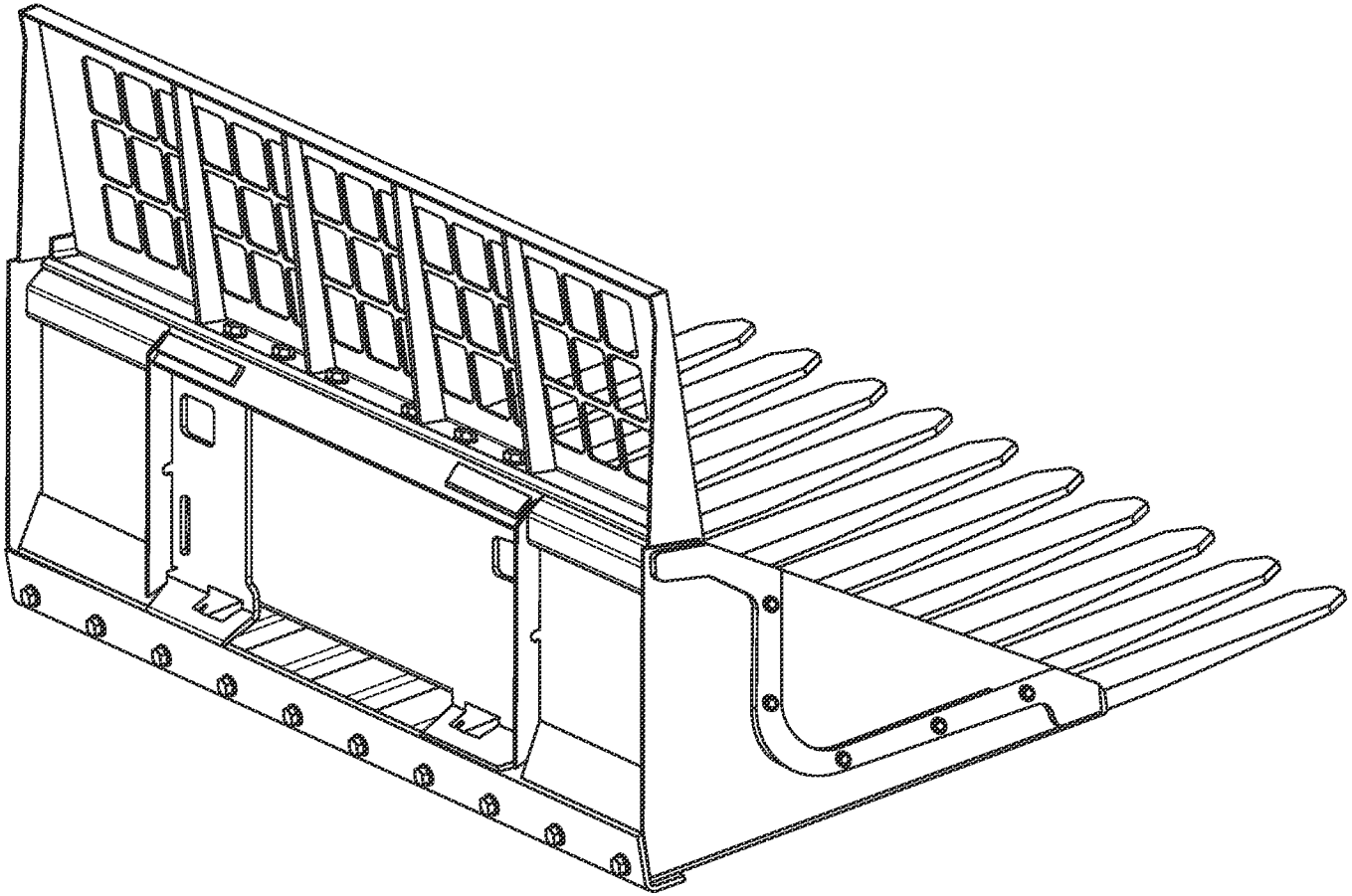
FIG. 11 illustrates a perspective view of an embodiment of the present multi-tine lifting implement.

FIG. 11 illustrates a perspective view of an embodiment of the present multi-tine lifting implement. FIG. 11 shows a multi-tine lifting bucket with removable sides and a removable top.

Figure 12:
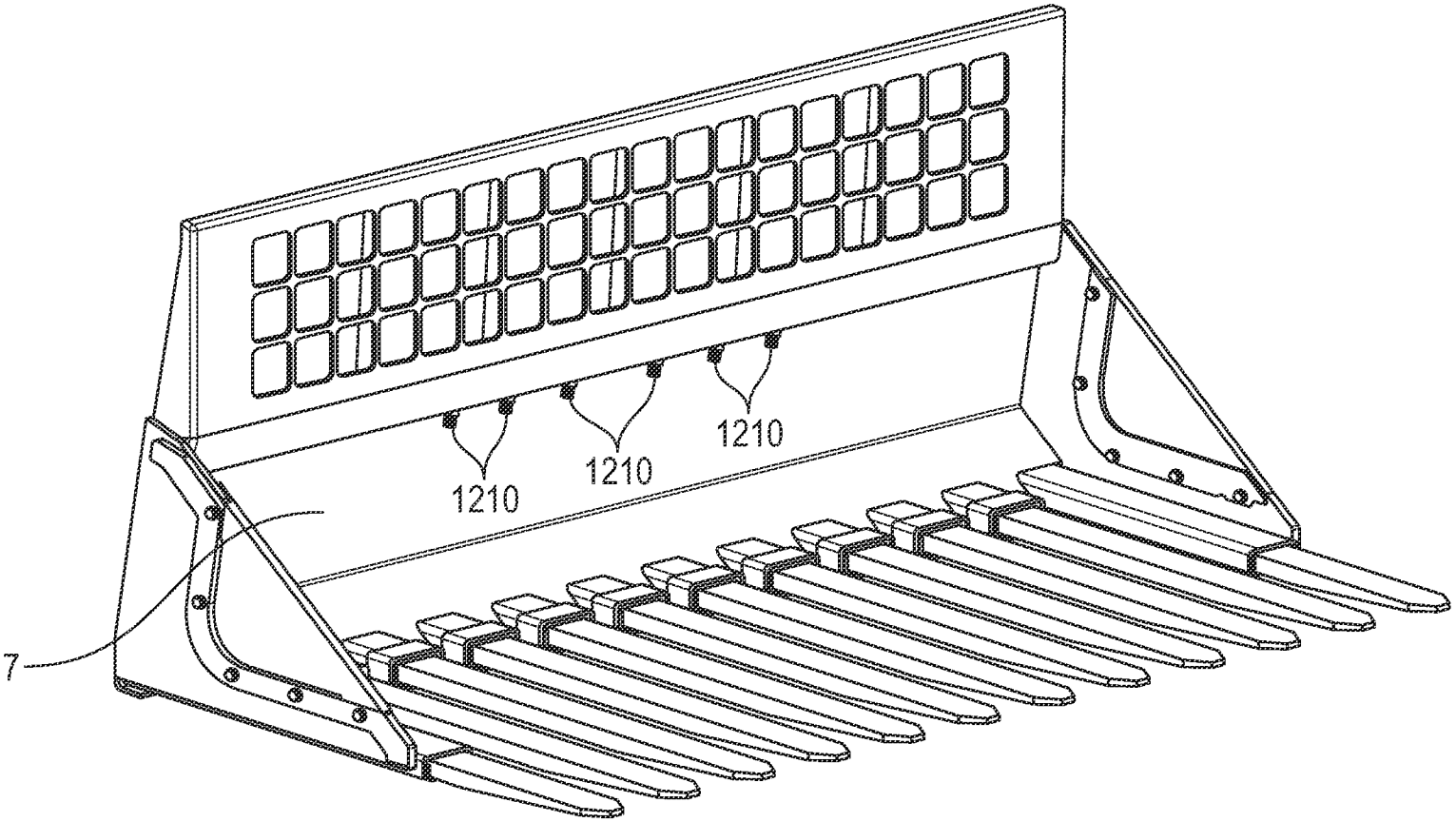
FIG. 12 illustrates a perspective view of an embodiment of the present multi-tine lifting implement.

FIG. 12 illustrates a perspective view of an embodiment of the present multi-tine lifting implement. FIG. 12 shows a multi-tine lifting bucket with removable sides and a removable top. Also shown in FIG. 12 are ends of bolts 1210 for attaching implements to the top tube 110 of the support member 7.

Figure 13:
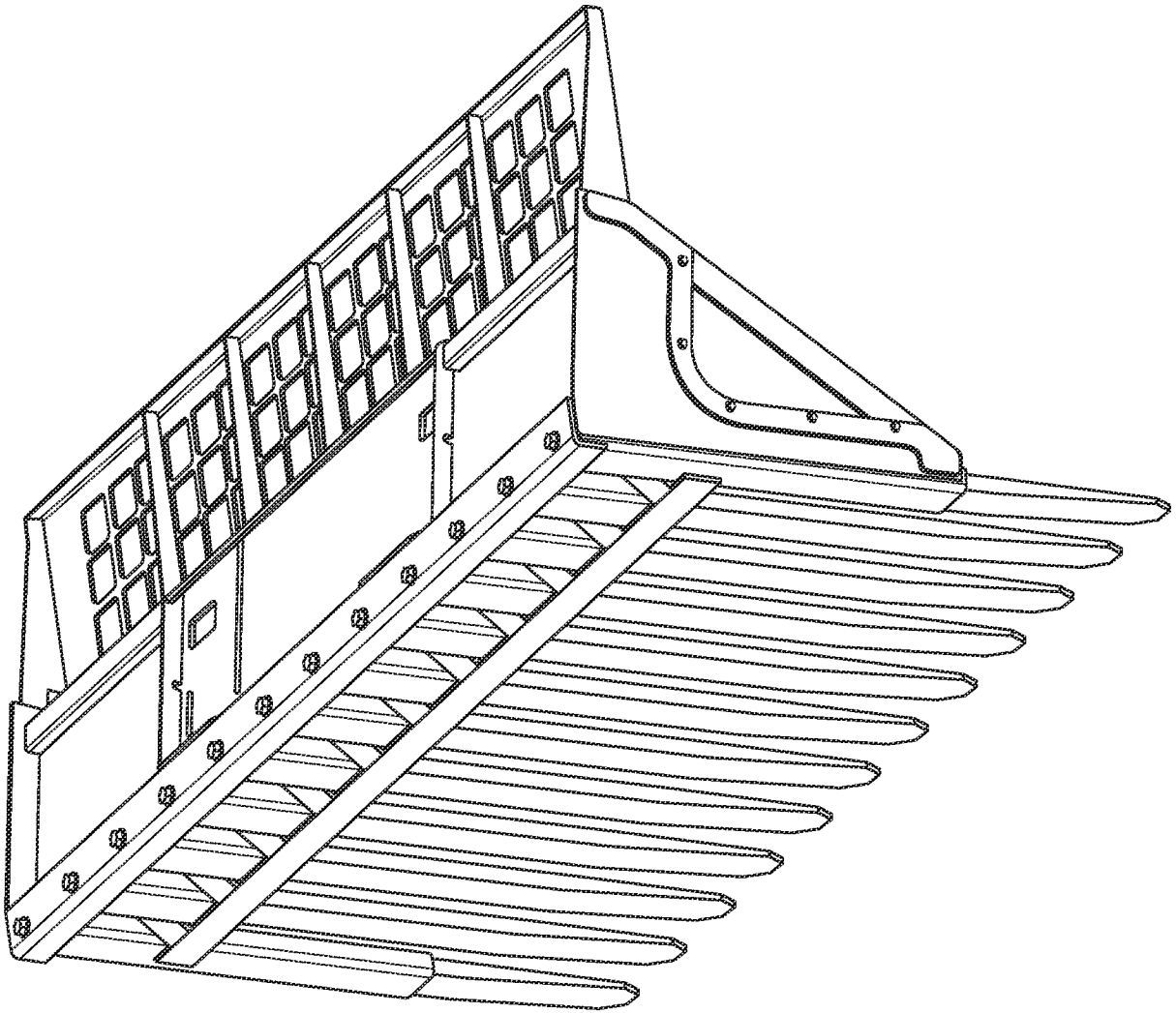
FIG. 13 illustrates a perspective view of an embodiment of the present multi-tine lifting implement.

FIG. 13 illustrates a perspective view of an embodiment of the present multi-tine lifting implement. FIG. 13 shows a multi-tine lifting bucket with removable sides and a removable top.

Figure 14:
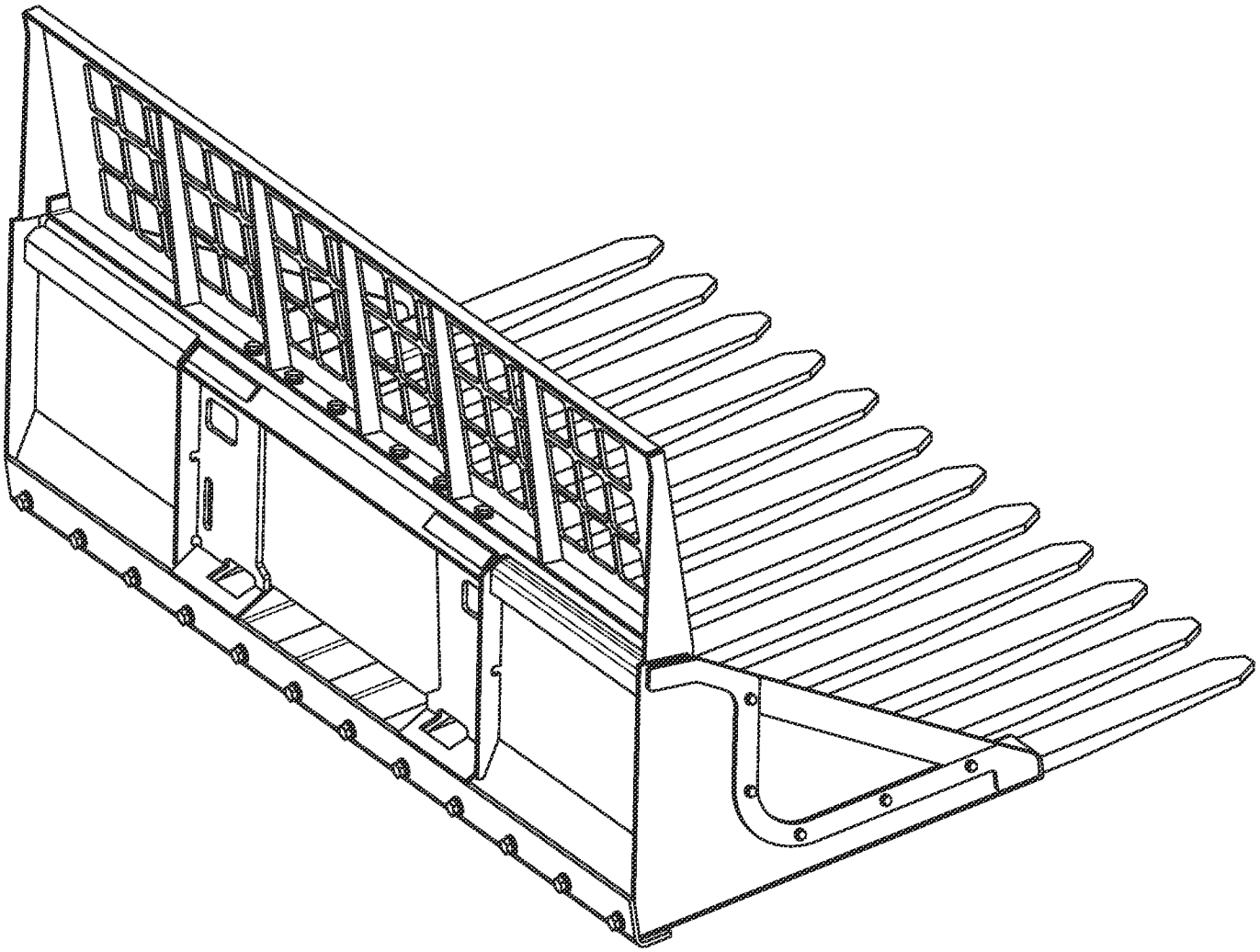
FIG. 14 illustrates a perspective view of an embodiment of the present multi-tine lifting implement.

FIG. 14 illustrates a perspective view of an embodiment of the present multi-tine lifting implement. FIG. 14 shows a multi-tine lifting bucket with removable sides and a removable top.

Figure 15:
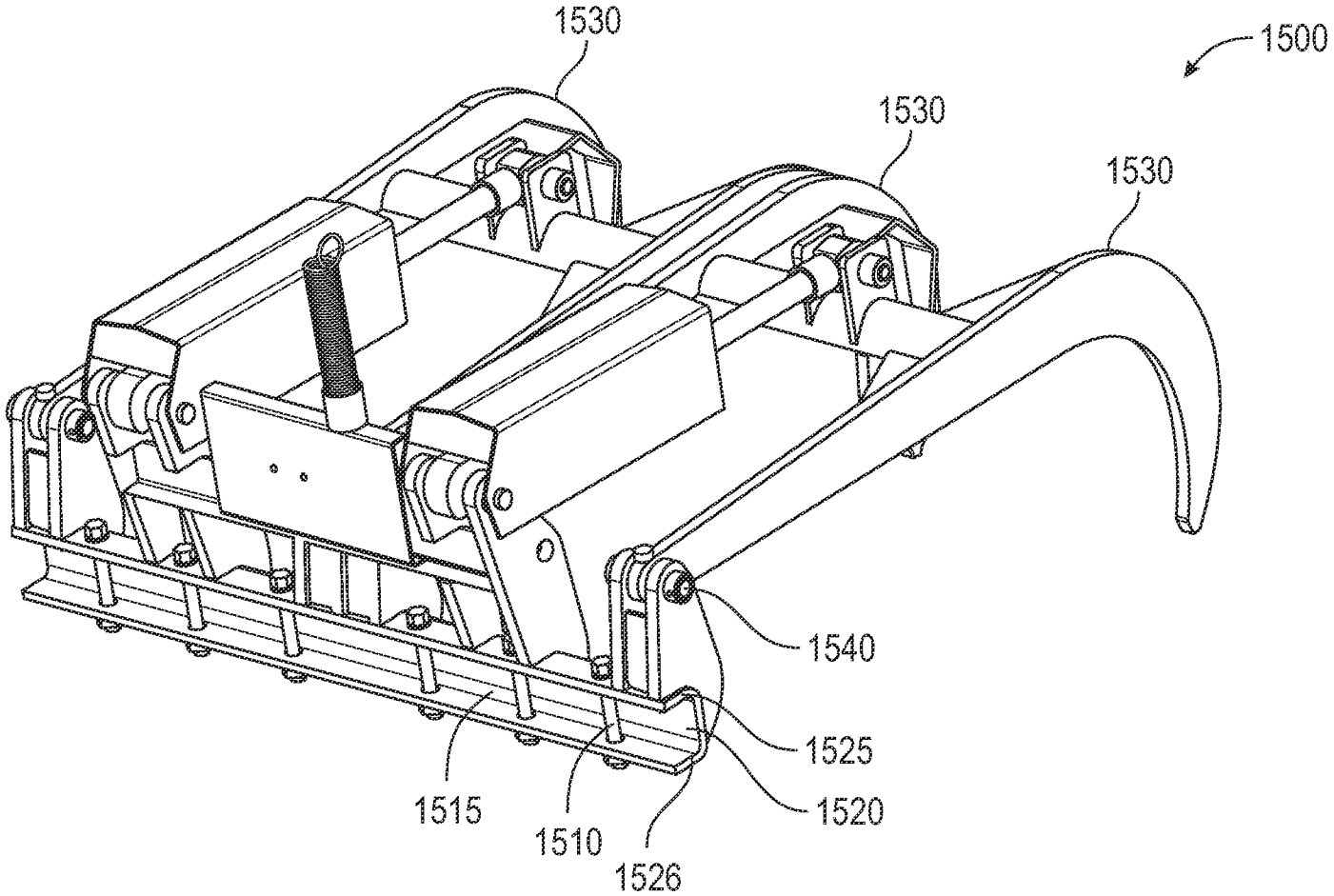
FIG. 15 illustrates a perspective view of an example grapple attachment of the present multi-tine lifting implement.

FIG. 15 illustrates a perspective view of an embodiment of the present multi-tine lifting implement. FIG. 15 shows a multi-tine lifting claw 1500 that may be fixedly attached to the multi-tine lifting bucket. Multi-tine lifting claw 1500, commonly referred to as a grapple, is removably couplable to plate 80 at the top of the support member 7 via multiple bolts 1510 or other means of attaching the claw 1500 to the support member 7. The bolts 1510 extend through a mating section 1515 comprising a flat plate 1520 to be placed on plate 80, and two sides 1525, 1526 with the bolts extending through the plate 80 as shown at 1210 in FIG. 12.

Claw 1500 is shown with three claw tines 1530 having a claw or hook like shape, and one or more hydraulic pistons 1535 operating to rotate the claw tines 1530 toward and away from the tines 29 about an axis 1540 positioned proximate the top of the support member 7. The hook shaped portions are configured to engage an item between the hook shaped portions and the tines. By removing the side portions, items longer than the width of the tine system may be picked up and held between the claw tines 1530 and the tines 29. Such items may include logs and telephone poles, or other items. The claw tines may be moved to firmly grip the item.

In various embodiments, the claw 1500 or other attachment may be the same width as the support member, wider, or narrower. The claw 1500 may include 3 claw tines or hooks, or a different number, such as 1, 2, 4, 5, 6, or more.

Figure 16:
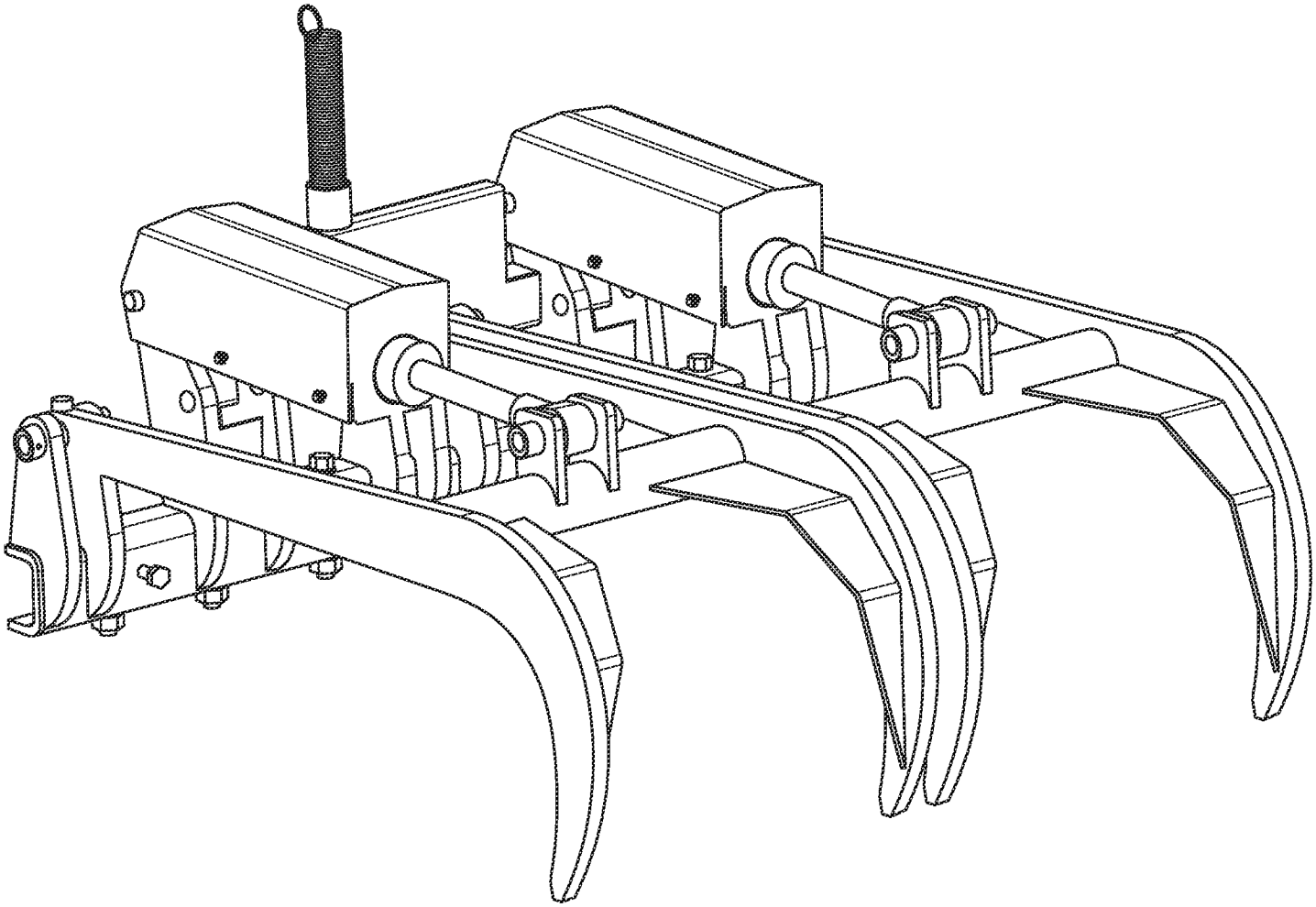
FIG. 16 illustrates a perspective view of an example grapple attachment of the present multi-tine lifting implement.

FIG. 16 illustrates a perspective view of an embodiment of the present multi-tine lifting implement. FIG. 16 shows a multi-tine lifting claw that may be fixedly attached to the multi-tine lifting bucket.

Figure 17:
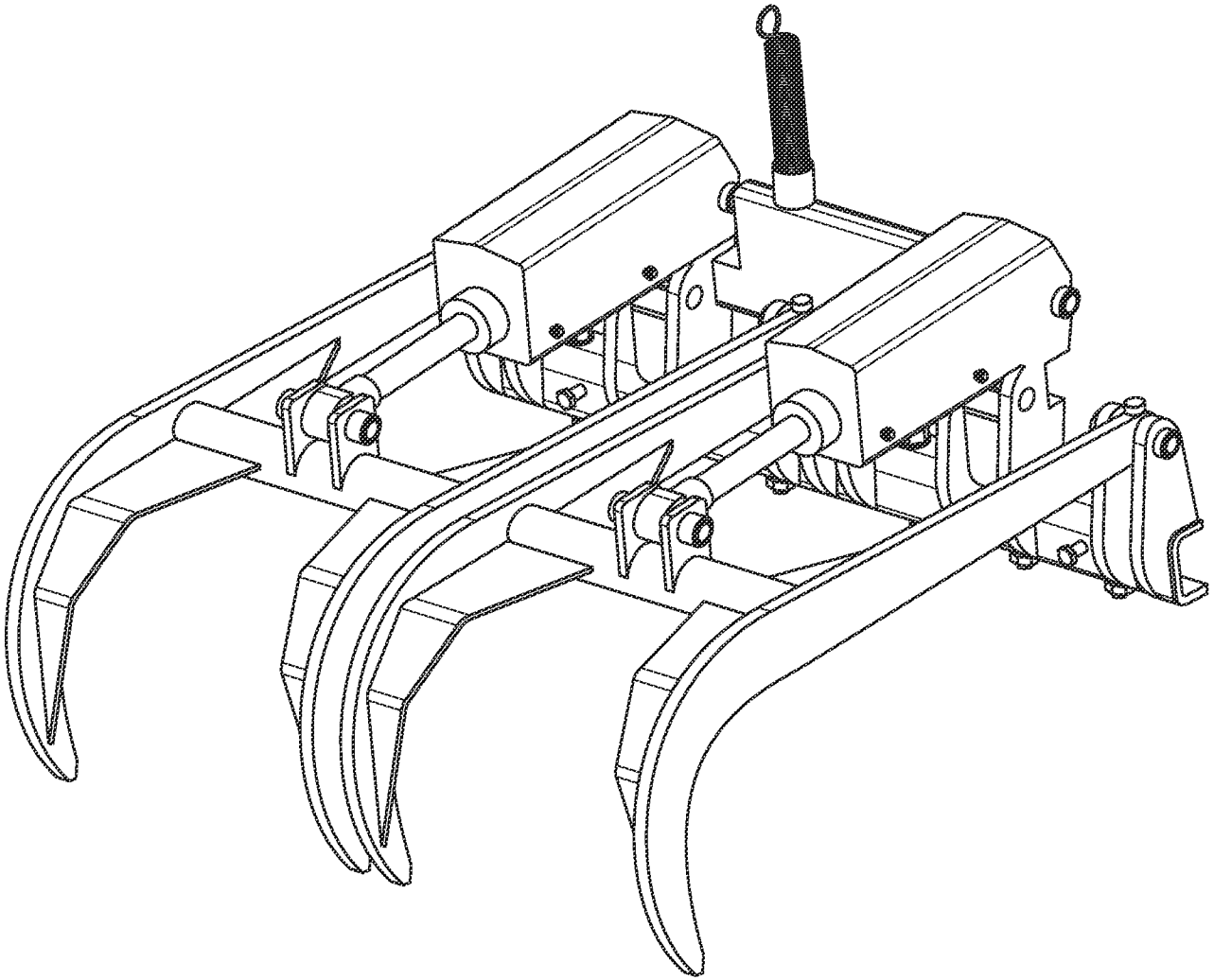
FIG. 17 illustrates a perspective view of an example grapple attachment of the present multi-tine lifting implement.

FIG. 17 illustrates a perspective view of an embodiment of the present multi-tine lifting implement. FIG. 17 shows a multi-tine lifting claw that may be fixedly attached to the multi-tine lifting bucket.

Figure 18:
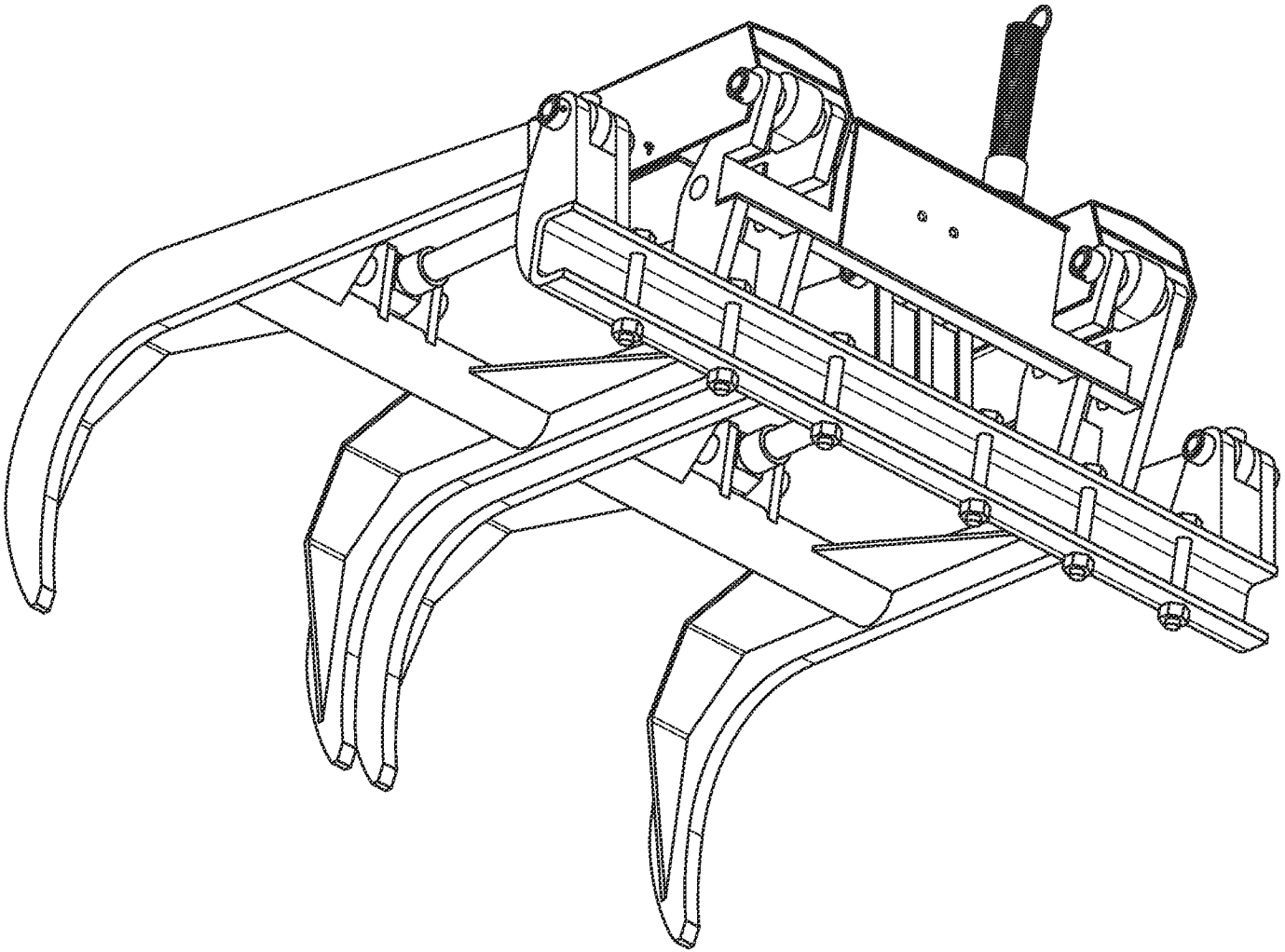
FIG. 18 illustrates a perspective view of an example grapple attachment of the present multi-tine lifting implement.

FIG. 18 illustrates a perspective view of an embodiment of the present multi-tine lifting implement. FIG. 18 shows a multi-tine lifting claw that may be fixedly attached to the multi-tine lifting bucket.

Figure 19:
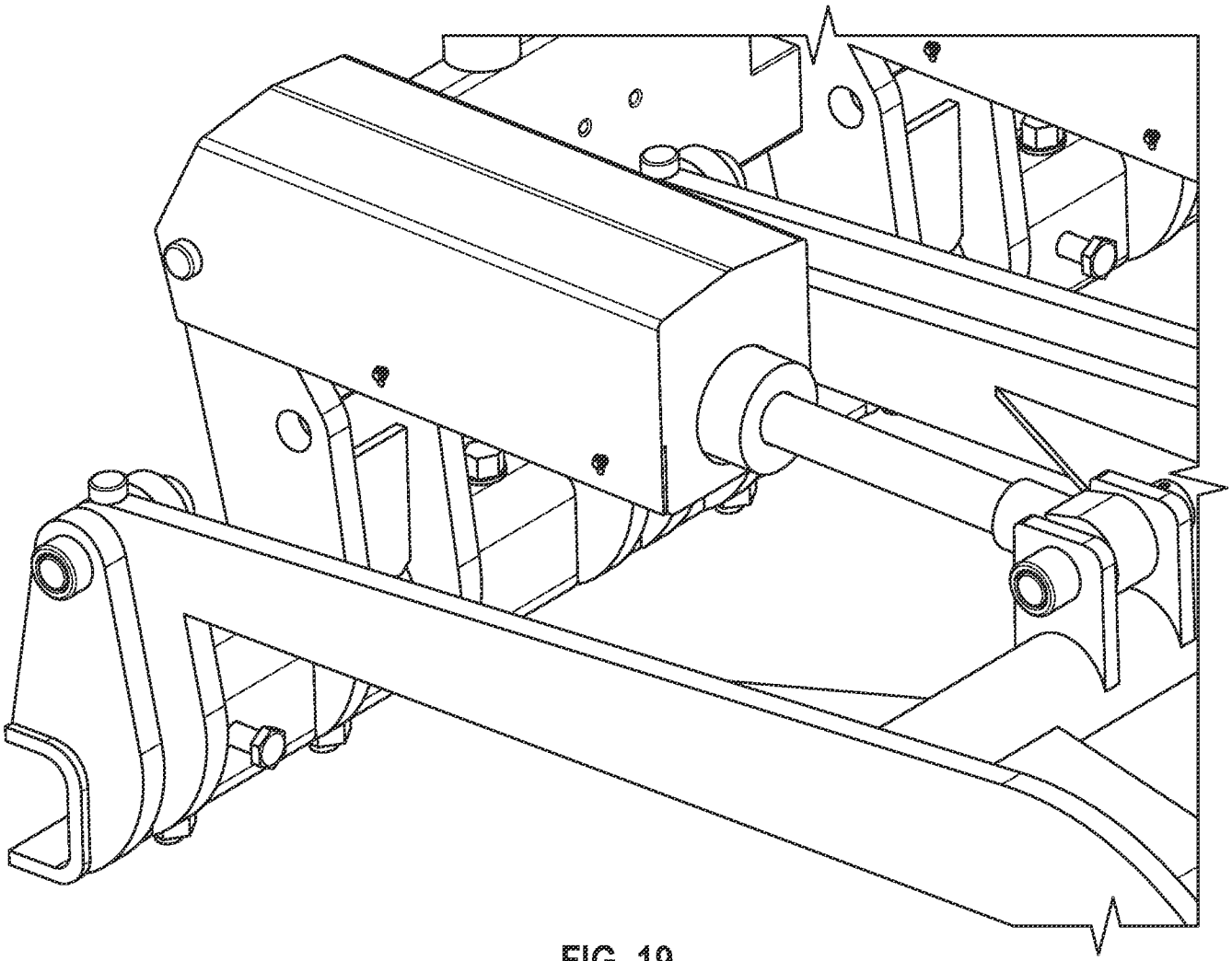
FIG. 19 illustrates a perspective view of an example grapple attachment of the present multi-tine lifting implement.

FIG. 19 illustrates a perspective view of an embodiment of the present multi-tine lifting implement. FIG. 19 shows a multi-tine lifting claw that may be fixedly attached to the multi-tine lifting bucket.

Figure 20:
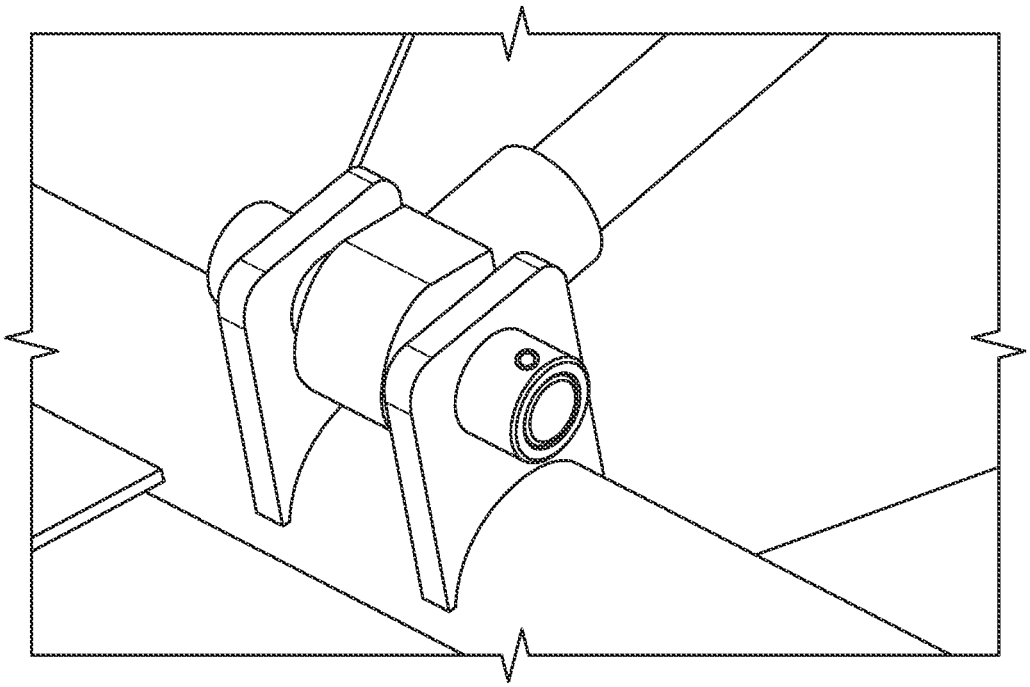
FIG. 20 illustrates a perspective view of an example grapple attachment of the present multi-tine lifting implement.

FIG. 20 illustrates a perspective view of an embodiment of the present multi-tine lifting implement. FIG. 20 shows a multi-tine lifting claw that may be fixedly attached to the multi-tine lifting bucket.

Figure 21:
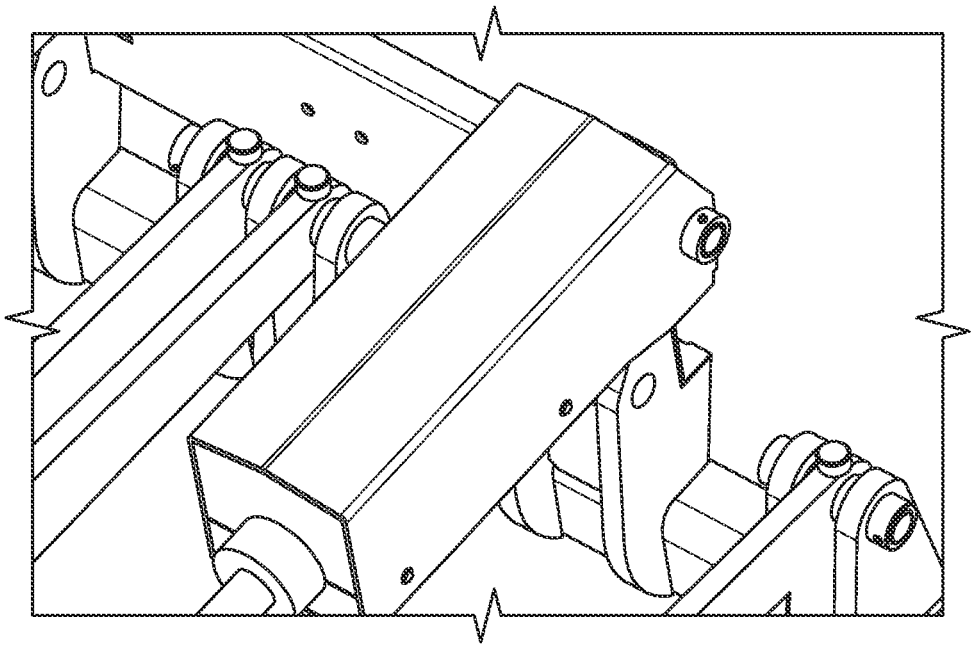
FIG. 21 illustrates a perspective view of an example grapple attachment of the present multi-tine lifting implement.

FIG. 21 illustrates a perspective view of an embodiment of the present multi-tine lifting implement. FIG. 21 shows a multi-tine lifting claw that may be fixedly attached to the multi-tine lifting bucket.

Figure 22:
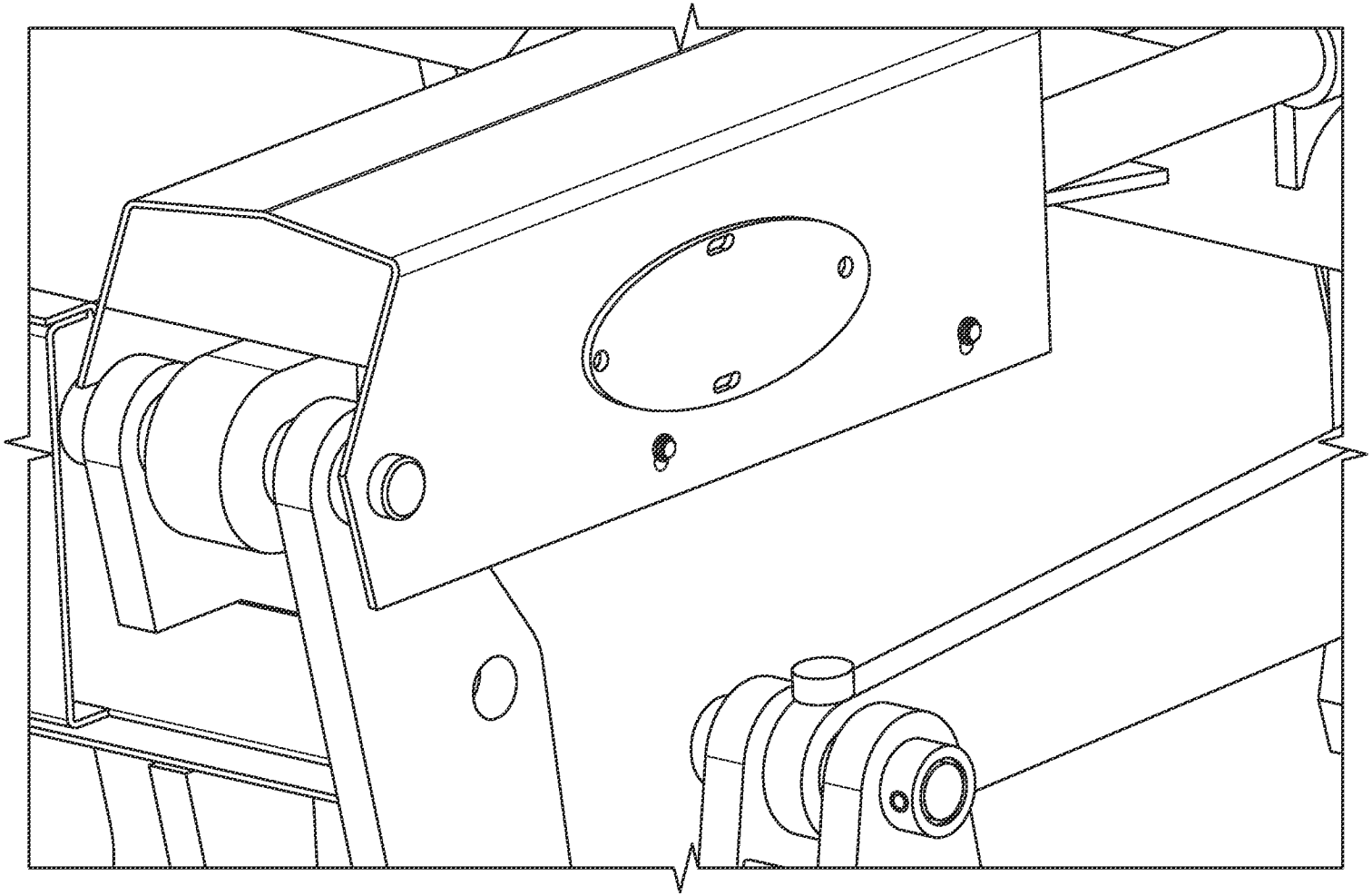
FIG. 22 illustrates a perspective view of an example grapple attachment of the present multi-tine lifting implement.

FIG. 22 illustrates a perspective view of an embodiment of the present multi-tine lifting implement. FIG. 22 shows a multi-tine lifting claw that may be fixedly attached to the multi-tine lifting bucket.

Figure 23:
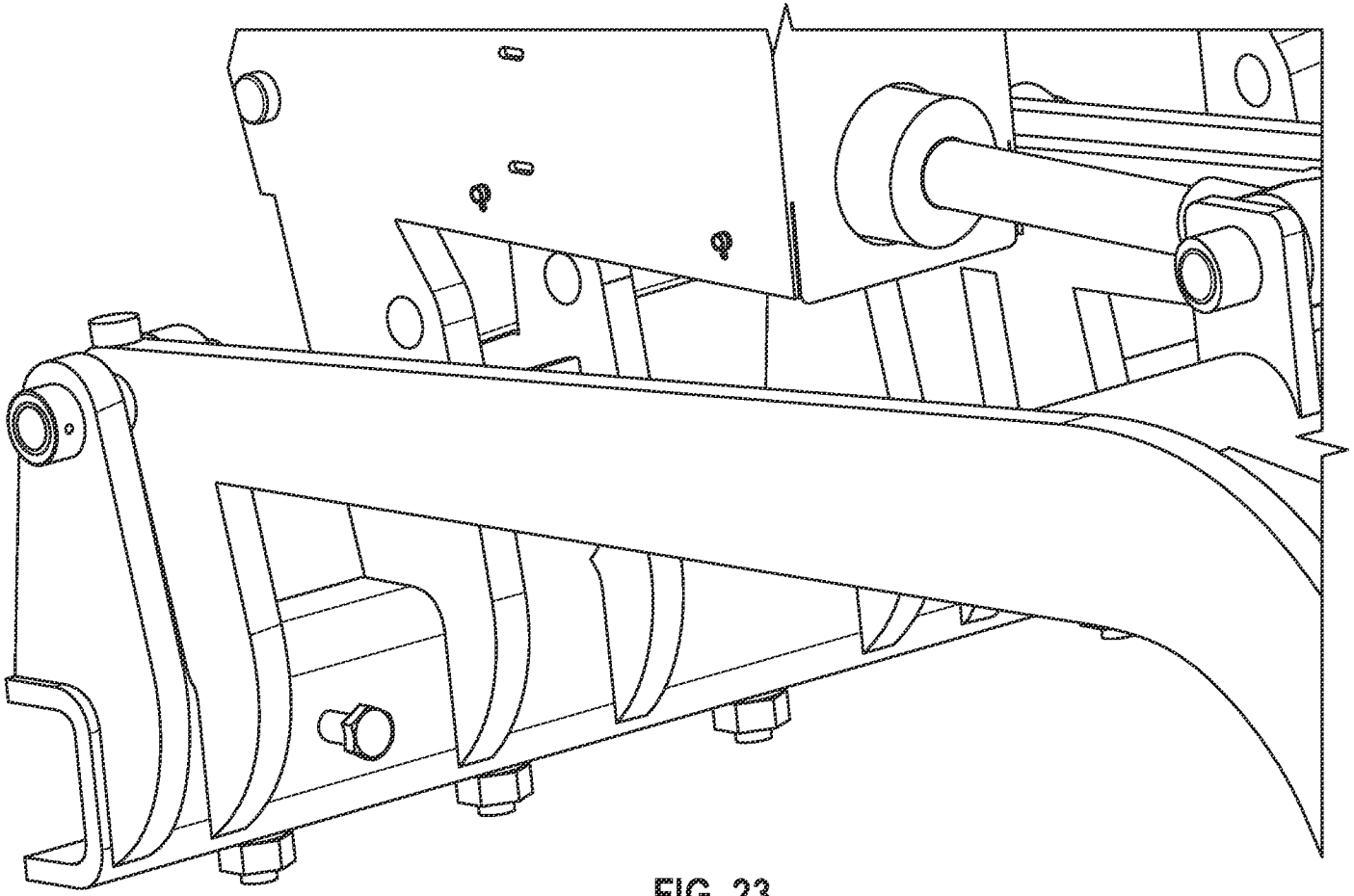
FIG. 23 illustrates a perspective view of an example grapple attachment of the present multi-tine lifting implement.

FIG. 23 illustrates a perspective view of an embodiment of the present multi-tine lifting implement. FIG. 23 shows a multi-tine lifting claw that may be fixedly attached to the multi-tine lifting bucket.

FIG. 24 illustrates a schematic view of an embodiment of the present multi-tine lifting implement.

FIG. 25 illustrates a schematic view of an embodiment of the present multi-tine lifting implement.

Figure 26:
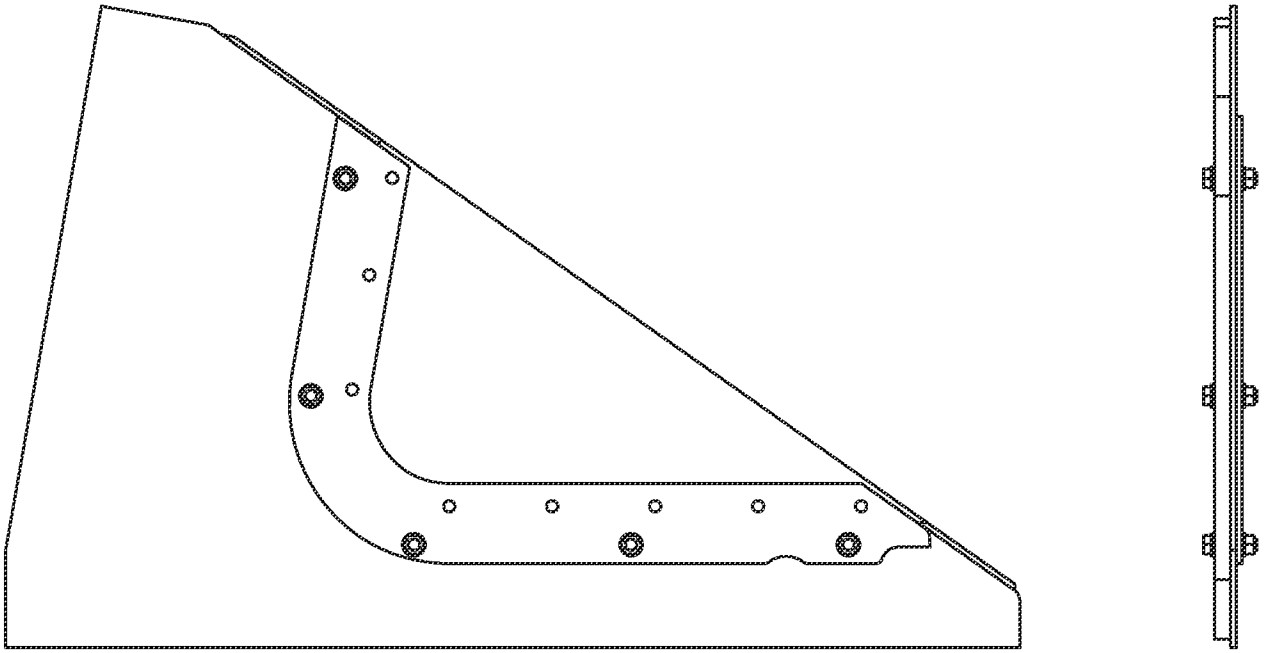
FIG. 26 illustrates a schematic view of an example removable side portion of the present multi-tine lifting implement.

FIG. 26 illustrates a schematic view of an embodiment of the present multi-tine lifting implement.

Figure 27:
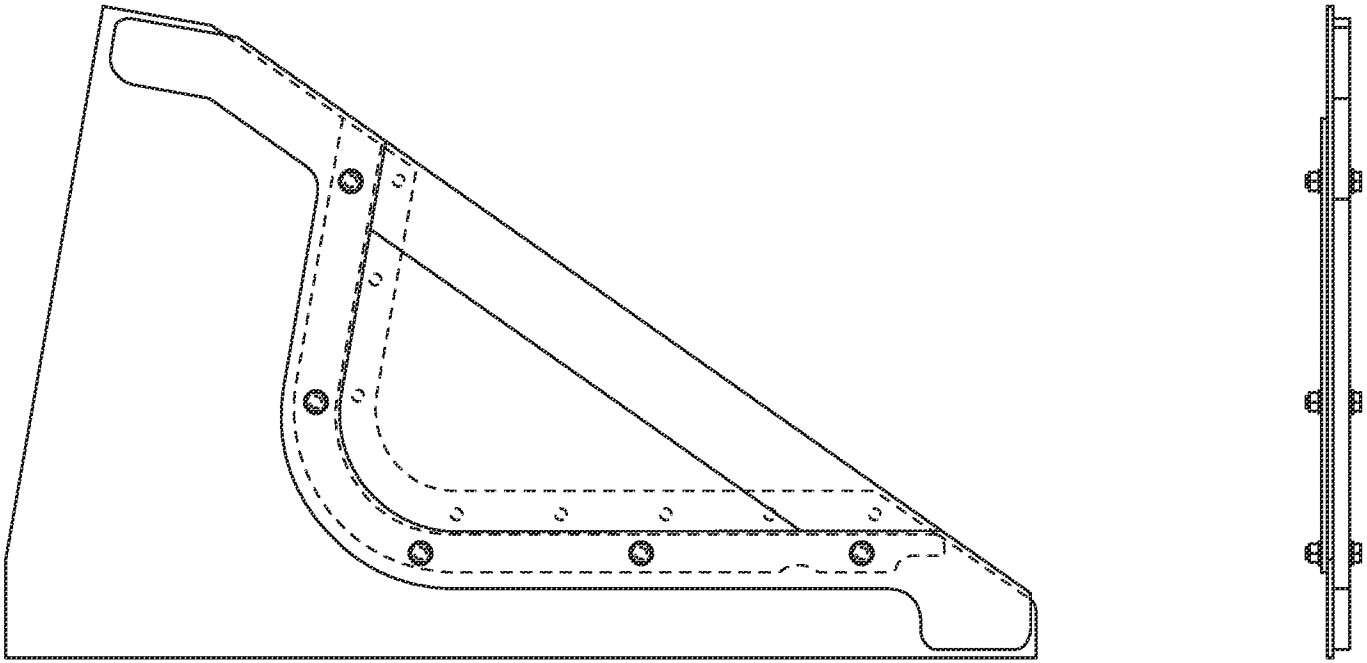
FIG. 27 illustrates a schematic view of an example removable side portion of the present multi-tine lifting implement.

FIG. 27 illustrates a schematic view of an embodiment of the present multi-tine lifting implement.

Figure 28:
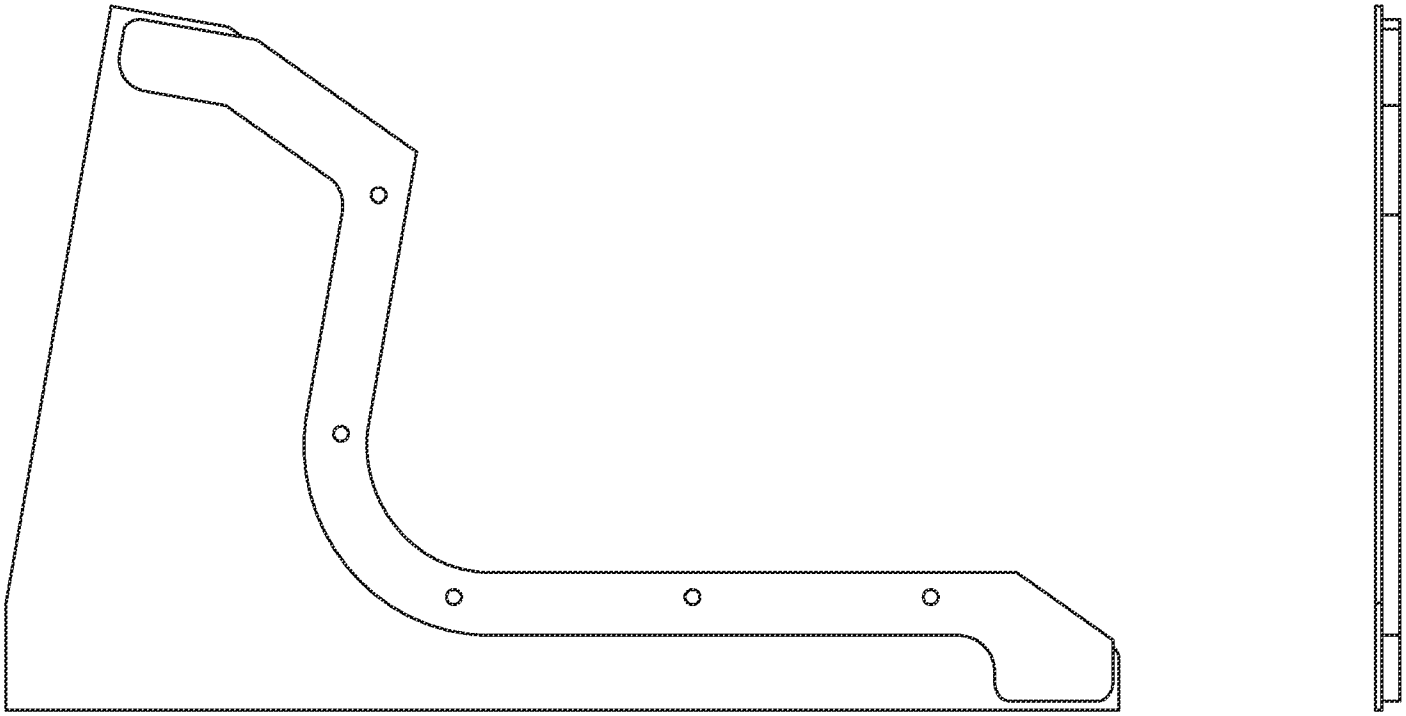
FIG. 28 illustrates a schematic view of an example removable side portion of the present multi-tine lifting implement.

FIG. 28 illustrates a schematic view of an embodiment of the present multi-tine lifting implement.

Figure 29:
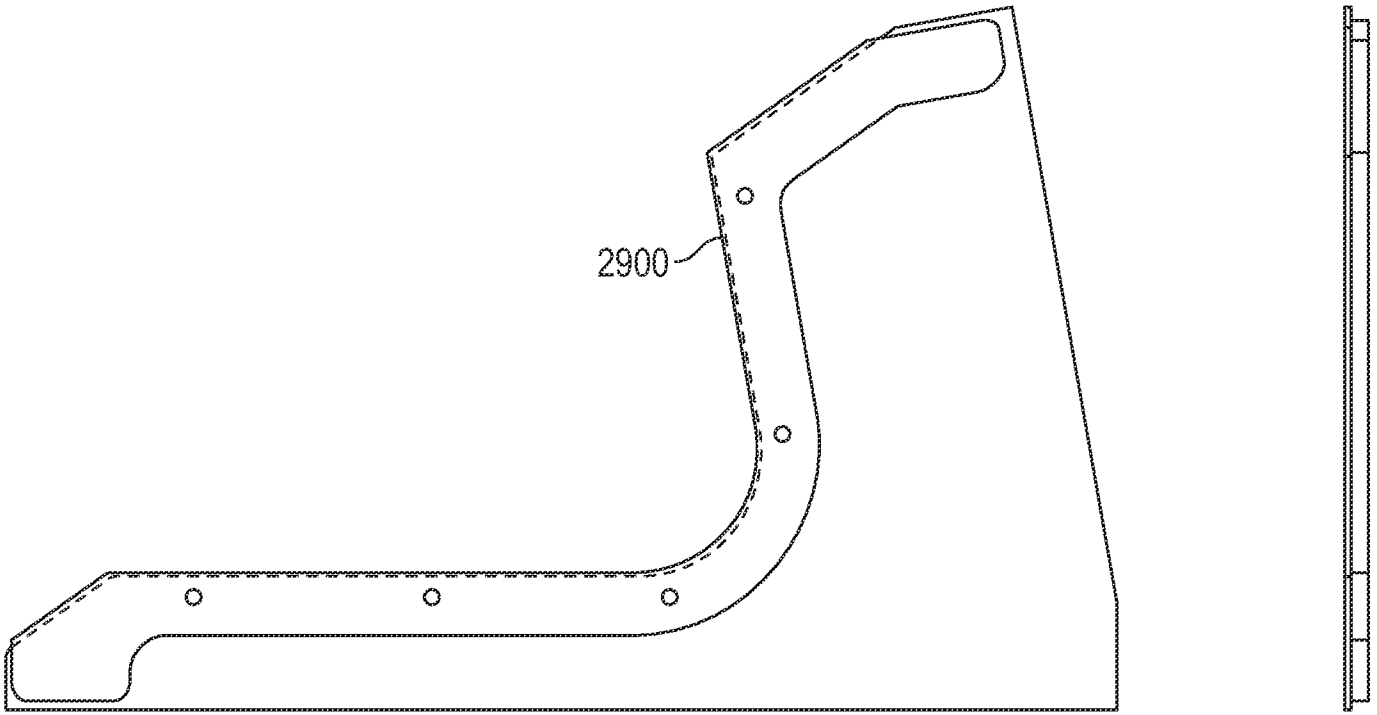
FIG. 29 illustrates a schematic view of an example removable side portion of the present multi-tine lifting implement.

FIG. 29 illustrates a schematic view of an embodiment of the present multi-tine lifting implement. A reinforcement tube 2900 may be welded to the top of side members 45. The tube 2900 may be fairly thick to support the bolts for the removeable side portions.

Figure 30:
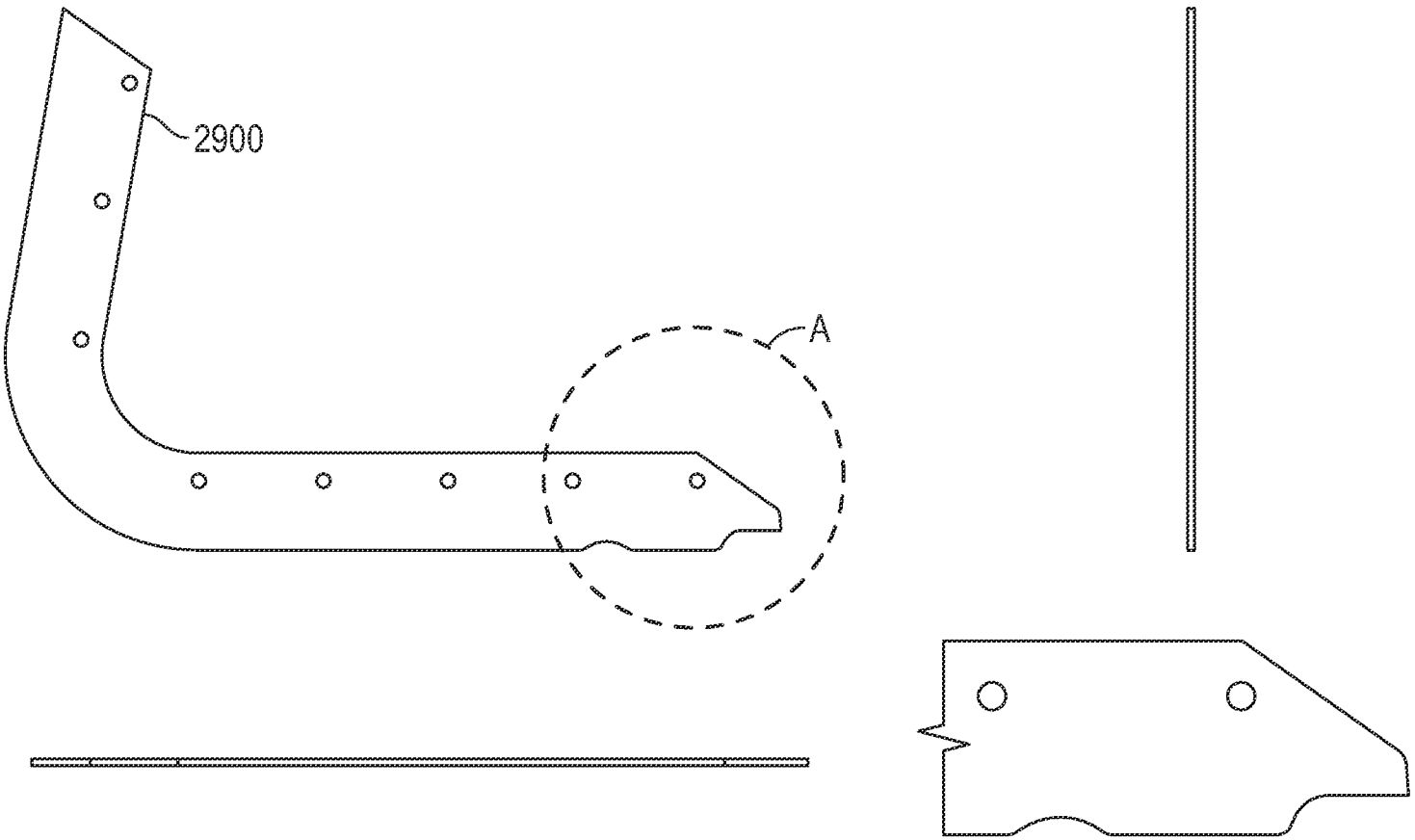
FIG. 30 illustrates a schematic view of an embodiment of the present multi-tine lifting implement.

FIG. 30 illustrates a schematic view of an embodiment of the present multi-tine lifting implement. A flange 3000 may be used to further strengthen the side members.

FIG. 31 illustrates a schematic view of an embodiment of the present multi-tine lifting implement.

Figure 32:
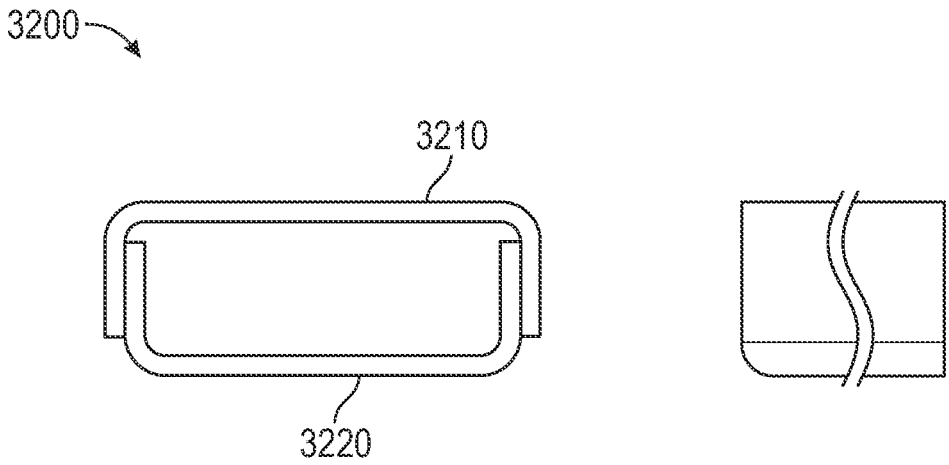
FIG. 32 is a cross section view of an alternative sleeve construction for supporting tines according to an example embodiment.

FIG. 32 is a cross section view of an alternative sleeve 3200 construction for supporting tines 29 according to an example embodiment. Sleeve 3200 includes two nesting U-shaped sleeve portions 3210 and 3220, with portion 3220 having legs that mate inside legs of portion 3210. This simple construction provides sufficient strength to alleviate the need for a reinforcement strap, and in addition is a simple design that may be easily modified for any size tine. The portions may be welded together or otherwise securely coupled to each other.

The present subject matter is applicable to a number of different multi-tine lifting implements and methods employing them. Accordingly, the present subject matter should not be considered limited to the particular examples described above, but rather should be understood to cover all aspects of the subject matter as fairly set out in the attached claims. Various modifications, equivalent processes, as well as numerous structures to which the present subject matter may be applicable will be readily apparent to those of skill in the art upon review of the present specification. The claims are intended to cover such modifications and devices.

What is claimed is:

1. A multi-tine lifting implement comprising:

a support member and one or more side members, the support member being adapted and configured for coupling the lifting implement to a vehicle;

three or more generally parallel and coplanar tines, each tine being supported by and projecting forward from the support member, adjacent tines defining a void therebetween; and each side member including a side support member extending upward from a tine on an edge of the lifting implement extending forward from the support member, and a removable side portion removably coupled to the side support member;

wherein:

the support member further comprises a plurality of sleeves;

each sleeve comprised of two mating U-shaped portions being adapted and configured for fit over a tine; and the two mating U-shaped portions nest, with one portion having legs coupled to an inside of legs of the other portion and sized to fit around a tine.

2. The implement of claim 1 wherein each side member is arranged and configured for retaining objects on the tines when the removable side portion is coupled to the side support member.

3. The implement of claim 2, further including a plurality of fasteners coupling the at least one removable side portion to the side member.

4. The implement of claim 2, wherein the plurality of fasteners include at least one of a plurality of removable bolts, a plurality of removable screws, and a plurality of removable rivets.

5. The implement of claim 1 further including a removable upper portion removably coupled to the support member and extending upward from a top edge of the support member.

6. The implement of claim 5 and further comprising a removable grapple removably coupleable to the support member utilizing openings resulting from removal of the upper portion.

7. The implement of claim 6 wherein the grapple comprises moveable hook shaped portions configured to engage an item between the hook shaped portions and the tines, wherein the item is longer than the width of the tine system, and wherein the side portions are removed.

8. The implement of claim 1 and further comprising a stabilizing bar coupled to the plurality of sleeves to limit lateral movement of the tines supported by the plurality of sleeves.

9. The implement of claim 1, and further comprising a reinforcing strap around each sleeve, wherein the sleeves are supported by the support member with a void between adjacent tines, wherein the sleeves are configured to retain the tines in a generally parallel orientation.

10. The implement of claim 1 wherein each side support member is coupled to an outer sleeve of the plurality of sleeves.

11. The implement of claim 10, wherein the removable side portions comprise a generally triangular plate coupled to the side support member.

12. The implement of claim 1 wherein the tines have a horizontal width greater than their thickness.

13. A lifting device comprising:

a support member having a coupling mechanism for attaching to a machine;

a top support coupled along a top edge of the support member and having openings configured to selectively attach an upper portion extending up from a top of the support member, or a grapple device;

a pair of side supports coupled to side edges of the support member; and a plurality of tines supported by the support member and extending forward between the side supports, the plurality of tines having a combined width within the side supports;

wherein:

the support member further comprises a plurality of sleeves;

each sleeve comprised of two mating U-shaped portions being adapted and configured for fit over a tine; and the two mating U-shaped portions nest, with one portion having legs coupled to an inside of legs of the other portion and sized to loosely fit a tine.

14. The lifting device of claim 13 wherein the lifting device is configured to grab and lift items extending beyond the side supports.

15. The implement of claim 1 wherein the sleeves are not welded or otherwise coupled to tines to provide advantageous shock absorbing and a small degree of flexibility in movement of the tines.

* * * * *